US012398907B2

(12) United States Patent
Lee et al.

(10) Patent No.: US 12,398,907 B2
(45) Date of Patent: Aug. 26, 2025

(54) VENTILATION SYSTEM, INTEGRATED AIR CONDITIONING SYSTEM AND CONTROL METHOD THEREOF

(71) Applicant: SAMSUNG ELECTRONICS CO., LTD., Suwon-si (KR)

(72) Inventors: Donggyu Lee, Suwon-si (KR); Kyunghoon Kim, Suwon-si (KR); Seojeong Kim, Suwon-si (KR); Sunggoo Kim, Suwon-si (KR); Seonuk Na, Suwon-si (KR); Hyeongjoon Seo, Suwon-si (KR); Changmin Seok, Suwon-si (KR); Seonghyun Yoon, Suwon-si (KR); Mingi Cho, Suwon-si (KR); Sungjune Cho, Suwon-si (KR); Seungkwan Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 512 days.

(21) Appl. No.: 17/566,033

(22) Filed: Dec. 30, 2021

(65) Prior Publication Data

US 2022/0178575 A1 Jun. 9, 2022

Related U.S. Application Data

(63) Continuation of application No. PCT/KR2021/017777, filed on Nov. 29, 2021.

(30) Foreign Application Priority Data

Dec. 8, 2020 (KR) ..... 10-2020-0170638
Aug. 18, 2021 (KR) ..... 10-2021-0108551

(51) Int. Cl.
*F24F 11/65* (2018.01)
*F24F 3/14* (2006.01)
(Continued)

(52) U.S. Cl.
CPC ..... *F24F 11/65* (2018.01); *F24F 3/1405* (2013.01); *F24F 11/0001* (2013.01);
(Continued)

(58) Field of Classification Search
CPC ..... F24F 12/006; F24F 12/001; F24F 12/002; F24F 11/65; F24F 11/52; F24F 2110/10;
(Continued)

(56) References Cited

U.S. PATENT DOCUMENTS 9,429,332 B2 8/2016 Vandermeulen et al.
10,323,867 B2 6/2019 Vandermeulen
(Continued)

FOREIGN PATENT DOCUMENTS

JP 2008-185330 8/2008
JP 2013-104619 5/2013
(Continued)

OTHER PUBLICATIONS

International Search Report dated Mar. 17, 2022 from International Application No. PCT/KR2021/017777.
(Continued)

*Primary Examiner* — Tavia Sullens
(74) *Attorney, Agent, or Firm* — STAAS & HALSEY LLP

(57) ABSTRACT

An integrated air conditioning system includes a ventilation device comprising a first temperature sensor, a first humidity sensor, and a heat exchanger installed on the inlet flow path. An indoor unit configured to discharge heat-exchanged air into an indoor space. An outdoor unit configured to supply a refrigerant to the ventilation device and the indoor unit. A controller connected to the ventilation device, the indoor unit, and the outdoor unit. The controller configured to obtain an indoor temperature from the first temperature or the second temperature sensor. The controller configured to
(Continued)

obtain indoor humidity from the first humidity sensor or the second humidity sensor and configured to control at least one of the ventilation device and the indoor unit based on the indoor temperature and the indoor humidity.

17 Claims, 15 Drawing Sheets

(51) Int. Cl.

| | |
|---|---|
| ***F24F 11/00*** | (2018.01) |
| ***F24F 11/52*** | (2018.01) |
| ***F24F 110/10*** | (2018.01) |
| ***F24F 110/20*** | (2018.01) |
| ***F25B 41/31*** | (2021.01) |
| ***F25B 41/325*** | (2021.01) |

(52) U.S. Cl.
CPC ..... *F24F 11/52* (2018.01); *F25B 41/31* (2021.01); *F25B 41/325* (2021.01); *F24F 2003/1452* (2013.01); *F24F 2011/0002* (2013.01); *F24F 2110/10* (2018.01); *F24F 2110/20* (2018.01)

(58) Field of Classification Search
CPC ..... F24F 2110/20; F24F 11/0001; F24F 2011/0002; F24F 2003/1452; F25B 41/32; F25B 41/325
See application file for complete search history.

(56) References Cited

U.S. PATENT DOCUMENTS

| | | | | |
|---|---|---|---|---|
| 2014/0000836 | A1 | 1/2014 | Xu et al. | |
| 2017/0254555 | A1* | 9/2017 | Tae | F24F 11/61 |
| 2021/0063042 | A1 | 3/2021 | Bak et al. | |
| 2022/0146130 | A1 | 5/2022 | Kwon et al. | |

FOREIGN PATENT DOCUMENTS

| | | | |
|---|---|---|---|
| JP | 5549773 | B1 | 7/2014 |
| JP | 2016-121841 | | 7/2016 |
| JP | 6305525 | | 4/2018 |
| JP | 6377933 | B2 | 8/2018 |
| JP | 2020-51680 | | 4/2020 |
| JP | 2021-110474 | | 8/2021 |
| JP | 2021-188811 | | 12/2021 |
| KR | 10-0259823 | | 6/2000 |
| KR | 10-0728590 | | 6/2007 |
| KR | 10-0816042 | | 3/2008 |
| KR | 100816042 | B1 * | 6/2008 |
| KR | 10-1424578 | | 8/2014 |
| KR | 10-1502096 | | 3/2015 |
| KR | 10-2017-0090837 | | 8/2017 |
| KR | 10-2017-0103133 | A | 9/2017 |
| KR | 10-2019-0019737 | | 2/2019 |
| KR | 10-2020-0106400 | | 9/2020 |
| KR | 10-2020-0131108 | | 11/2020 |
| KR | 10-2021-0026645 | | 3/2021 |
| KR | 10-2021-0146019 | | 12/2021 |
| KR | 10-2022-0057054 | | 5/2022 |
| WO | WO-2017081820 | A1 * | 5/2017 |
| WO | WO-2019193639 | A1 * | 10/2019 |

OTHER PUBLICATIONS

Extended European Search Report dated Jan. 4, 2024. for European Application No. 21903714.0.
European Office Action dated Jun. 10, 2025 for European Application No. 21903714.0.

* cited by examiner

VENTILATION SYSTEM, INTEGRATED AIR CONDITIONING SYSTEM AND CONTROL METHOD THEREOF

CROSS-REFERENCE TO RELATED APPLICATION

This application is a continuation application under 35 U.S.C. § 111(a) of PCT Application No. PCT/KR2021/017777 filed Nov. 29, 2021 which claims the benefit of Korean Patent Application No. 10-2020-0170638 filed on Dec. 8, 2020 and Korean Patent Application No. 10-2021-0108551 filed on Aug. 18, 2021. The contents of PCT Application No. PCT/KR2021/017777 filed Nov. 29, 2021 and Korean Patent Application No. 10-2020-0170638 and Korean Patent Application No. 10-2021-0108551 are incorporated by reference herein in their entirety.

FIELD

The present disclosure relates to a ventilation system, an integrated air conditioning system, and a control method thereof, capable of providing fresh air to an indoor space.

BACKGROUND

A ventilation device is a device that supplies outdoor air to an indoor space or exchanges indoor air with outdoor air to ventilate the indoor space.

A conventional ventilation device has no choice but to control an indoor temperature and humidity only through total heat exchange that is performed between outdoor air and indoor air while the outdoor air and the indoor air pass through a total heat exchanger. Accordingly, the dehumidification of the outdoor air supplied to the indoor space is incomplete, and it is difficult to maintain the indoor temperature and humidity in a fresh state.

SUMMARY

The present disclosure is directed to providing a ventilation system, an integrated air conditioning system, and a control method thereof, capable of regulating a temperature and humidity of air supplied to an indoor space in a fresh state.

Further, the present disclosure is directed to providing a ventilation system, an integrated air conditioning system, and a control method thereof, capable of being operated using a conventional outdoor unit of air conditioner.

Further, the present disclosure is directed to providing a ventilation system, an integrated air conditioning system, and a control method thereof, capable of improving cooling efficiency and dehumidification efficiency by operating a ventilation device and an indoor unit of an air conditioner in conjunction with each other.

One aspect of the present disclosure provides an integrated air conditioning system including a ventilation device including a first temperature sensor, a first humidity sensor, an inlet flow path provided to suck outdoor air and guide the sucked air to an indoor space, an outlet flow path provided to guide indoor air to an outdoor space, and a heat exchanger installed on the inlet flow path; an indoor unit including a second temperature sensor, a second humidity sensor, and an indoor heat exchanger, the indoor unit configured to discharge heat-exchanged air into an indoor space; an outdoor unit configured to supply a refrigerant to the ventilation device and the indoor unit; and a controller electrically connected to the ventilation device, the indoor unit, and the outdoor unit. The controller is configured to obtain an indoor temperature from the first temperature sensor provided in the ventilation device or the second temperature sensor provided in the indoor unit; configured to obtain indoor humidity from the first humidity sensor provided in the ventilation device or the second humidity sensor provided in the indoor unit; and configured to control at least one of the ventilation device and the indoor unit based on the indoor temperature and the indoor humidity.

Another aspect of the present disclosure provides a control method of an integrated air conditioning system including a ventilation device configured to suck outdoor air, discharge the sucked air to an indoor space, and discharge indoor air to an outdoor space, the ventilation device including a heat exchanger configured to exchange heat with outdoor air, an indoor unit including an indoor heat exchanger, the indoor unit configured to cool the indoor space, and an outdoor unit configured to supply a refrigerant to the ventilation device and the indoor unit, the control method including obtaining an indoor temperature from a first temperature sensor provided in the ventilation device or a second temperature sensor provided in the indoor unit; obtaining indoor humidity from a first humidity sensor provided in the ventilation device or a second humidity sensor provided in the indoor unit; and controlling at least one of the ventilation device and the indoor unit based on the indoor temperature and the indoor humidity.

It is possible to adjust a temperature and humidity of sucked outdoor air by using a plurality of heat exchangers arranged on an inlet flow path of a ventilation device, and to discharge the conditioned air to an indoor space. Therefore, it is possible maintain the temperature and humidity of the indoor space in a fresh state.

Further, it is possible to connect a ventilation device to a conventional outdoor unit of air conditioner so as to miniaturize the ventilation device and to reduce a production cost.

Further, by operating a ventilation device and an indoor unit of an air conditioner in conjunction with each other, it is possible to improve energy efficiency and dehumidification efficiency and to reduce energy for cooling and dehumidification.

Further, by appropriately switching an operation of an indoor unit and an operation of a ventilation device based on a load of an indoor temperature, it is possible to improve energy efficiency.

Figure 1:
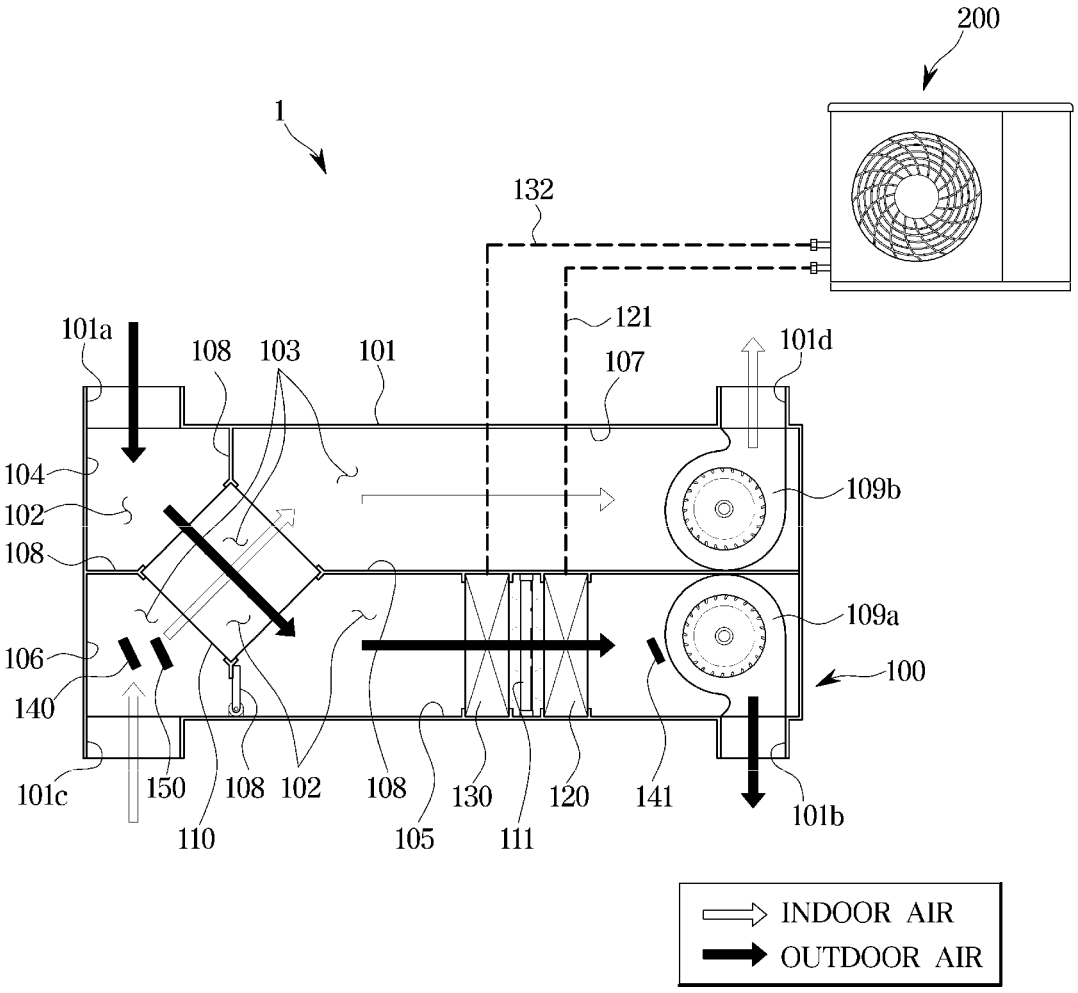
FIG. 1 is a view illustrating a ventilation system according to one embodiment of the present disclosure.

Detailed Description Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function. The shapes and sizes of elements in the drawings may be exaggerated for clear description.

It will be understood that when an element is referred to as being "connected" another element, it can be directly or indirectly connected to the other element, wherein the indirect connection includes "connection via a wireless communication network".

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following description, terms such as "unit", "part", "block", "member", and "module" indicate a unit for processing at least one function or operation. For example, those terms may refer to at least one process processed by at least one hardware such as Field Programmable Gate Array (FPGA), Application Specific Integrated Circuit (ASIC), at least one software stored in a memory or a processor.

An identification code is used for the convenience of the description but is not intended to illustrate the order of each step. The each step may be implemented in the order different from the illustrated order unless the context clearly indicates otherwise.

Hereinafter, embodiments of the disclosure will be described in detail with reference to the accompanying drawings.

Figure 2:
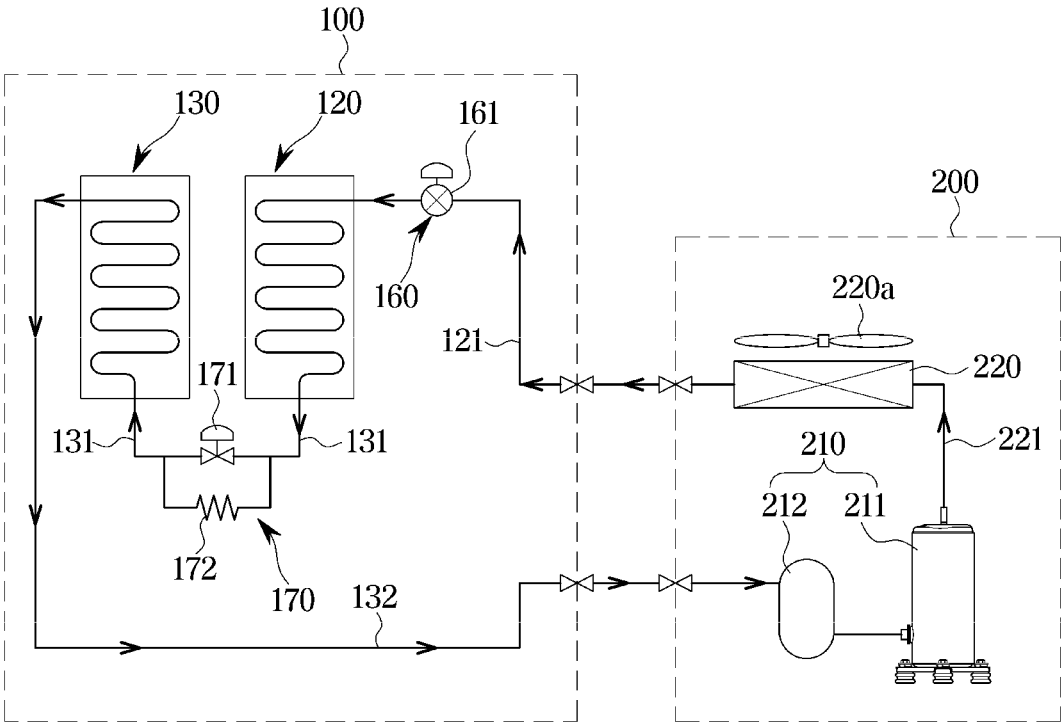
FIG. 2 is a view illustrating a circulation of a refrigerant in the ventilation system according to one embodiment of the present disclosure.
Figure 3:
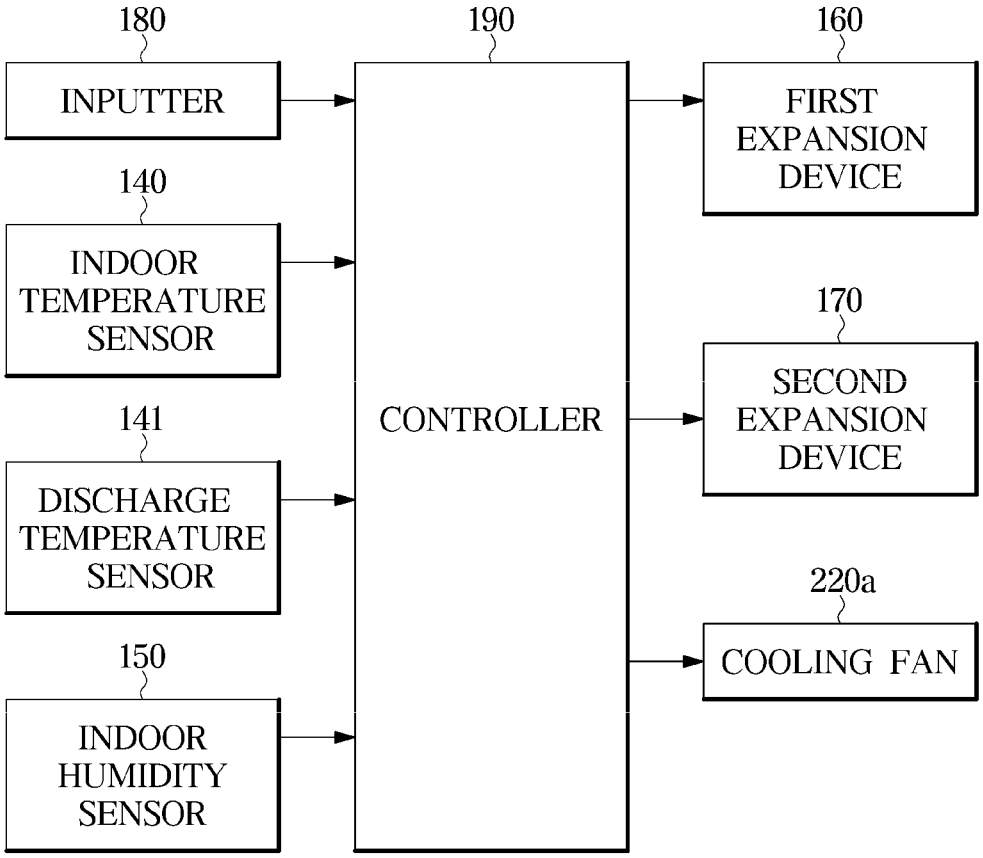
FIG. 3 is a control block diagram illustrating the ventilation system according to one embodiment of the present disclosure.

FIG. 1 is a view illustrating a ventilation system according to one embodiment of the present disclosure. FIG. 2 is a view illustrating a circulation of a refrigerant in the ventilation system according to one embodiment of the present disclosure. FIG. 3 is a control block diagram illustrating the ventilation system according to one embodiment of the present disclosure.

Referring to FIGS. 1 to 3, a ventilation system 1 may include a ventilation device 100 provided to communicate with an indoor space and an outdoor space and configured to exchange indoor air with outdoor air, and an outdoor unit 200 configured to circulate a refrigerant supplied to the ventilation device 100. The ventilation device 100 may also be referred to as ventilator 100.

The outdoor unit 200 may include a compressor 210 and a condenser 220. The compressor 210 may include an accumulator 212 and a compressor body 211. The condenser 220 may be referred to as an 'outdoor heat exchanger'. The compressor 210 and the condenser 220 may be connected through a refrigerant pipe 221. The outdoor unit 200 may include a cooling fan 220*a* configured to control a temperature of the condenser 220. The cooling fan 220*a* may discharge air toward the condenser 220 and may cool the condenser 220. When the condenser 220 is cooled by the cooling fan 220*a*, a temperature of the refrigerant passing through the condenser 220 may be reduced in comparison with a case in which the cooling fan 220*a* is not provided.

All drawings in the present disclosure schematically and exemplarily illustrate a configuration of the outdoor unit 200 at a practicable level. Because the outdoor unit 200 corresponds to an outdoor unit for an air conditioner commonly known in the art, a person skilled in the art can easily change or easily add various configurations necessary for the implementation of the outdoor unit 200. The outdoor unit 200 may be provided at a technical level that is generally understood by those skilled in the art based on the contents of the present disclosure.

As described above, because the ventilation system 1 may be operated by using the outdoor unit 200 that is commonly used, the ventilation device 100 does not include a separate compressor, and thus it is possible to miniaturize the ventilation device 100 and reduce production costs.

The ventilation device 100 may include a housing 101 provided to form an exterior. The housing 101 may be provided in a substantially box shape. The housing 101 may include an inlet flow path 102 guiding outdoor air into the indoor space and an outlet flow path 103 guiding indoor air to the outdoor space. The inlet flow path 102 and the outlet flow path 103 may be partitioned from each other by a plurality of partition walls 108.

The housing 101 may include a first inlet chamber 104 and a second inlet chamber 105. The first inlet chamber 104 may include a first inlet 101*a* provided to communicate with the outdoor space to allow the outdoor air to be sucked into the inside of the housing 101, and the inlet flow path 102 may be formed in the first inlet chamber 104. The second inlet chamber 105 may include a first outlet 101*b* provided to communicate with the indoor space to allow the outdoor air, which is to be sucked into the housing 101, to be discharged to the indoor space and the inlet flow path 102 may be formed in the second inlet chamber 105. The inlet flow path 102 may connect the first inlet 101*a* to the first outlet 101*b*.

The housing 101 may include a first outlet chamber 106 and a second outlet chamber 107. The first outlet chamber 106 may include a second inlet 101*c* provided to communicate with the indoor space to allow the indoor air to be sucked into the inside of the housing 101, and the outlet flow path 103 may be formed in the first outlet chamber 106. The second outlet chamber 107 may include a second outlet 101*d* provided to communicate with the outdoor space to allow the indoor air, which is to be sucked into the housing 101, to be discharged to the outside and the outlet flow path 103 may be formed in the second outlet chamber 107. The outlet flow path 103 may connect the second inlet 101*c* to the second outlet 101*d*.

The ventilation device 100 may include an intake blower 109*a* arranged inside the second inlet chamber 105, and configured to generate a force required to suck the outdoor air into the indoor space, and provided to communicate with the first outlet 101*b*. The ventilation device 100 may include an exhaust blower 109*b* arranged inside the second outlet chamber 107, and configured to generate a blowing force required to discharge the indoor air into the outside, and provided to communicate with the second outlet 101*d*. The intake blower 109*a* may be referred to as 'a first blower' and the exhaust blower 109*b* may be referred to as 'a second blower'.

The ventilation device 100 may include a total heat exchanger 110 in which air, which flows through the outlet flow path 103 and air, which flows through the inlet flow path 102, exchange heat with each other. The total heat exchanger 110 may correspond to a plate type total heat exchanger or a rotary type total heat exchanger. The total heat exchanger 110 may be arranged on a point in which the inlet flow path 102 and the outlet flow path 103 intersect. That is, the total heat exchanger 110 may be arranged on the inlet flow path 102 and at the same time, arranged on the outlet flow path 103. The total heat exchanger 110 may be referred to as a 'total heat exchange element'. The total heat exchanger 110 may communicate the first inlet chamber 105 with the second inlet chamber 106. The total heat exchanger 110 may communicate the first outlet chamber 106 with the second outlet chamber 107.

The ventilation device 100 may include a first heat exchanger 120 and a second heat exchanger 130 configured to control humidity and temperature of the air flowing through the inlet flow path 102. The first heat exchanger 120 and the second heat exchanger 130 may be provided on the inlet flow path 102. The first heat exchanger 120 and the second heat exchanger 130 may be arranged inside the second inlet chamber 105. That is, the first heat exchanger 120 and the second heat exchanger 130 may be arranged on a downstream side of the inlet flow path 102 than the total heat exchanger 110.

The second heat exchanger 130 may be arranged on an upstream side of the inlet flow path 102 than the first heat exchanger 120. In other words, the first heat exchanger 120 may be arranged on the downstream side of the inlet flow path 102 than the second heat exchanger 130. The outdoor air sucked in through the first inlet 101*a* may sequentially pass through the first inlet chamber 104, the total heat exchanger 110, the second heat exchanger 130, and the first heat exchanger 120, and then be discharged into the indoor space by passing through the first outlet 101*b*.

Air, which flows through the inlet flow path 102 from the first inlet 101*a* toward the first outlet 101*b* may be dehumidified by the second heat exchanger 130. The air passing through the second heat exchanger 130 may be heated, cooled and dehumidified by the first heat exchanger 120.

The first heat exchanger 120 may be connected to the outdoor unit 200 through the first refrigerant pipe 121. The first heat exchanger 120 may be connected to the condenser 220 of the outdoor unit 200 through the first refrigerant pipe 121.

The second heat exchanger 130 may be connected to the first heat exchanger 120 through a second refrigerant pipe 131. The second heat exchanger 130 may be connected to the outdoor unit 200 through a third refrigerant pipe 132. The second heat exchanger 130 may be connected to the accumulator 212 of the outdoor unit 200 through the third refrigerant pipe 132.

The ventilation device 100 may include a first expansion device 160 provided in the first refrigerant pipe 121. The first expansion device 160 may also be referred to as first expansion valve 160. The first expansion device 160 may selectively expand a refrigerant supplied to the first heat exchanger 120 through the first refrigerant pipe 121. The refrigerant passing through the first expansion device 160 may be in a reduced pressure state than before passing through the first expansion device 160.

The ventilation device 100 may include a second expansion device 170 provided in the second refrigerant pipe 131. The second expansion device 170 may also be referred to as second expansion valve 170. The second expansion device 170 may selectively expand a refrigerant that is discharged from the first heat exchanger 120 and supplied to the second heat exchanger 130 through the second refrigerant pipe 131. The refrigerant passing through the second expansion device 170 may be in a reduced pressure state than before passing through the second expansion device 170.

The first expansion device 160 and the second expansion device 170 may be arranged inside the housing 101. The second refrigerant pipe 131 may be arranged inside the housing 101.

The first expansion device 160 may expand a high-temperature and high-pressure refrigerant into a low-temperature and low-pressure refrigerant by a throttling action, and may adjust a flow rate of the refrigerant supplied to the first heat exchanger 120. The first expansion device 160 may reduce the pressure of the refrigerant by using a throttling action of the refrigerant in which the pressure of the refrigerant decreases without heat exchange with the outside when the refrigerant passes through a narrow flow path. For example, the first expansion device 160 may include an electronic expansion valve (EEV) 161. The EEV 161 may regulate a degree of opening to control a degree of expansion of the refrigerant and a flow rate of the refrigerant. When the EEV 161 is fully opened, the refrigerant may pass through the EEV 161 without resistance, and the refrigerant may not be expanded.

The second expansion device 170 may expand a high-temperature and high-pressure refrigerant into a low-temperature and low-pressure refrigerant by the throttling action. For example, the second expansion device 170 may include a solenoid valve 171 and a capillary tube 172 connected in parallel with the solenoid valve 171. When the solenoid valve 171 is closed, the refrigerant may move to the capillary tube 172 and be expanded by the throttling action, and when the solenoid valve 171 is opened, the refrigerant may flow without resistance through the solenoid valve 171 and not be expanded. In order to efficiently control the flow and expansion of the refrigerant, the solenoid valve 171 may be replaced with an EEV.

However, the present disclosure is not limited thereto. For example, both the first expansion device 160 and the second expansion device 170 may include an EEV. The first expansion device 160 may include a solenoid valve and a capillary tube connected in parallel to the solenoid valve, and the second expansion device 170 may include an EEV. Both the first expansion device 160 and the second expansion device 170 may include a solenoid valve and a capillary tube connected in parallel with the solenoid valve. It should be understood that a solenoid valve connected in parallel with a capillary tube may be replaced with an EEV.

The ventilation system 1 may include a controller 190 configured to control the ventilation device 100 and/or the outdoor unit 200 based on an indoor temperature, indoor humidity, and/or discharge temperature. The controller 190 may be provided in the ventilation device 100. The controller 190 may be electrically connected to the first expansion device 160 and the second expansion device 170, and may control the first expansion device 160 and the second expansion device 170. In addition, the controller 190 may be electrically connected to a controller 500 of an integrated air conditioning system 2 to be described later, and may transmit and receive electrical signals and/or data to and from the controller 500. For example, the controller 190 may control an operation of the ventilation device 100 based on an electrical signal transmitted from the controller 500.

The controller 190 may control the first expansion device 160 to expand or not expand the refrigerant by adjusting the opening and closing of the EEV 161 of the first expansion device 160 and the degree of opening/closing thereof. The controller 190 may control the second expansion device 170 to expand or not expand the refrigerant by adjusting the opening and closing of the solenoid valve 171 of the second expansion device 170.

The controller 190 may control a rotation speed of the cooling fan 220*a* of the outdoor unit 200. The controller 190 may increase or decrease the rotation speed of the cooling fan 220*a*. As the rotation speed of the cooling fan 220*a* increases, the condenser 220 of the outdoor unit 200 may radiate more heat, and the temperature of the refrigerant passing through the condenser 220 may be further reduced.

The ventilation system 1 may include an indoor temperature sensor 140 configured to measure an indoor temperature and an indoor humidity sensor 150 configured to measure indoor humidity. The ventilation system 1 may include a discharge temperature sensor 141 configured to measure a discharge temperature, which is a temperature of air discharged into the indoor space after passing through the first and second heat exchangers 120 and 130. The humidity may refer to relative humidity. The indoor temperature sensor 140, the indoor humidity sensor 150, and the discharge temperature sensor 141 may be connected to the controller 190 by wire or wirelessly, and may transmit a measured value to the controller 190.

The ventilation system 1 may include an inputter 180 configured to receive a set temperature and set humidity. The inputter 180 may receive an input value for selecting a first dehumidification mode, a second dehumidification mode, or a ventilation mode. The inputter 180 may be provided in the ventilation device 100 or may be provided in an inputter (e.g., remote controller) provided separately from the ventilation device 100. The inputter 180 may be connected to the controller 190 by wire or wirelessly, and may transmit an input value to the controller 190.

In addition, the controller 190 may transmit an input value received through the inputter 180 of the ventilation device 100 to the controller 500 of the integrated air conditioning system 2 to be described later. The controller 500 may control the respective operations of the ventilation device 100, the outdoor unit 200, and the indoor unit 300 by comprehensively considering the input value, the indoor temperature, and the indoor humidity. The controller 500 may identify operation states of the ventilation device 100, the outdoor unit 200, and the indoor unit 300. The controller 500 may determine whether to operate each of the ventilation device 100, the outdoor unit 200, and the indoor unit 300 and determine an operation mode of the ventilation device 100, the outdoor unit 200, and the indoor unit 300. For example, the set temperature and set humidity input through the inputter 180 of the ventilation device 100 may be transmitted to the controller 500, and the controller 500 may use the set temperature and the set humidity to operate at least one of the ventilation device 100, the outdoor unit 200 or the indoor unit 300. In response to the ventilation device 100 being turned on and the indoor unit 300 being turned off, the controller 500 may control the operation of the ventilation device 100 to adjust the indoor temperature to be the set temperature and to adjust the indoor humidity to be the set humidity.

The indoor temperature sensor 140 and the indoor humidity sensor 150 may be provided on the outlet flow path 103. The indoor temperature sensor 140 and the indoor humidity sensor 150 may be arranged inside the first outlet chamber 106. The indoor temperature sensor 140 and the indoor humidity sensor 150 may be arranged on the upstream side of the outlet flow path 103 than the total heat exchanger 110. The indoor temperature sensor 140 and the indoor humidity sensor 150 may measure the temperature and humidity of the indoor air sucked through the second inlet 101*c*. However, the present disclosure is not limited thereto, and the indoor temperature sensor 140 and the indoor humidity sensor 150 may be arranged outside the housing 101. The indoor temperature sensor 140 provided in the ventilation device 100 may be referred to as a 'first temperature sensor', and the indoor humidity sensor 150 may be referred to as a 'first humidity sensor'.

The discharge temperature sensor 141 may be provided on the inlet flow path 102. The discharge temperature sensor 140 may be arranged inside the second inlet chamber 105. The discharge temperature sensor 141 may be arranged on the downstream side of the inlet flow path 102 than the total heat exchanger 110, the first heat exchanger 120, and the second heat exchanger 130. The discharge temperature sensor 141 may measure the temperature of the air discharged into the indoor space through the first outlet 101*b*. However, the present disclosure is not limited thereto, and the discharge temperature sensor 141 may be arranged outside the housing 101.

Further, the ventilation device 100 may include a sterilizer 111 configured to sterilize the first heat exchanger 120 and the second heat exchanger 130. The sterilizer 111 may include an ultraviolet light source configured to irradiate ultraviolet light. For example, the sterilizer 111 may include a UV-LED.

The sterilizer 111 may be arranged between the first heat exchanger 120 and the second heat exchanger 130. Accordingly, the single sterilizer 111 may simultaneously sterilize the first heat exchanger 120 and the second heat exchanger 130 arranged on opposite sides of the sterilizer 111.

Hereinafter the operation of the ventilation system 1 will be described in detail.

The ventilation device 100 may be operated in one of the first dehumidification mode, the second dehumidification mode, or the ventilation mode based on the indoor temperature and indoor humidity. The controller 190 may control the ventilation device 100 to be operated in the first dehumidification mode, the second dehumidification mode, or the ventilation mode. The ventilation device 100 may be operated while switching the first dehumidification mode, the second dehumidification mode, and the ventilation mode based on the indoor temperature and indoor humidity. The controller 190 may control switching between each mode.

The ventilation mode refers to a state in which no refrigerant is supplied to the first heat exchanger 120 and the second heat exchanger 130, and only total heat exchange by the total heat exchanger 110 is performed. The controller 190 may block the refrigerant flowing to the ventilation device 100 or block the refrigerant flowing to the ventilation device 100 so as to prevent the refrigerant from flowing into the first heat exchanger 120 and second heat exchanger 130, or turn off the outdoor unit 200, thereby allowing the ventilation system 1 to be operated in the ventilation mode.

The first dehumidification mode will be described. In the first dehumidification mode, the first expansion device 160 may expand the refrigerant. The second expansion device 170 may or may not expand the refrigerant. It is appropriate that the second expansion device 170 may not expand the refrigerant in the first dehumidification mode to allow the refrigerant to flow smoothly. For this, the solenoid valve 171 of the second expansion device 170 may be opened in the first dehumidification mode.

The high-temperature and high-pressure refrigerant discharged from the compressor body 211 may be condensed in the condenser 220 of the outdoor unit 200 and then introduced into the first expansion device 160. The first expansion device 160 may expand the high-temperature and high-pressure refrigerant to a low-temperature and low-pressure state to allow the refrigerant to be evaporated in the first heat exchanger 120 and the second heat exchanger 130.

The refrigerant expanded in the first expansion device 120 may be introduced into the first heat exchanger 120, and may be evaporated by exchanging heat with air passing through the first heat exchanger 120. The refrigerant discharged from the first heat exchanger 120 and introduced into the second heat exchanger 130 may be evaporated once again in the second heat exchanger 130. The first heat exchanger 120 and the second heat exchanger 130 may condense and remove moisture contained in the air passing through the first heat exchanger 120 and the second heat exchanger 130, and cool the air passing through the first heat exchanger 120 and the second heat exchanger 130. That is, the ventilation device 100 operated in the first dehumidification mode may simultaneously reduce the temperature and humidity of outdoor air sucked into the indoor space. By the ventilation device 100 operated in the first dehumidification mode, the air supplied to the indoor space may have a temperature and humidity that can be felt comfortably by the user. The ventilation device 100 operated in the first dehumidification mode may discharge cooled and dried air to the indoor space, and thus the first dehumidification mode may be referred to as a 'cooling and dehumidification mode'.

The second dehumidification mode will be described. In the second dehumidification mode, the first expansion device 160 may not expand the refrigerant. The second expansion device 170 may expand the refrigerant. The high-temperature and high-pressure refrigerant discharged from the compressor body 211 may be condensed in the condenser 220 of the outdoor unit 200 and then introduced into the first heat exchanger 120. The first heat exchanger 120 supplied with the refrigerant may condense the refrigerant. The high-temperature and high-pressure refrigerant discharged from the first heat exchanger 120 may be expanded by the second expansion device 170 to be a low-temperature and low-pressure refrigerant. The expanded refrigerant may be introduced into the second heat exchanger 130, and may be evaporated by heat exchange with air passing through the second heat exchanger 130.

In the second dehumidification mode, air flowing through the inlet flow path 102 may sequentially pass through the second heat exchanger 130 and the first heat exchanger 120. The second heat exchanger 130 may condense and remove moisture contained in the air passing through the second heat exchanger 130, and the air passing through the second heat exchanger 130 may be cooled and dehumidified. The first heat exchanger 120 may heat air, from which moisture is removed by the second heat exchanger 130, by condensing the refrigerant. The air, which is cooled by passing through the second heat exchanger 130, may be heated again by the first heat exchanger 120 and thus the air may have a temperature greater than when passing through the second heat exchanger 130. Accordingly, relative humidity of the air passing through the second heat exchanger 130 and the first heat exchanger 120 may be less than relative humidity of the air passing through only the second heat exchanger 130. Accordingly, the air having the temperature and humidity that can be comfortably felt by a user may be supplied to the indoor space. The ventilation device 100 operated in the second dehumidification mode may discharge dry air, which has the same or similar temperature to the indoor temperature, to the indoor space, and thus the second dehumidification mode may be referred to as a 'constant temperature dehumidification mode'.

Figure 4:
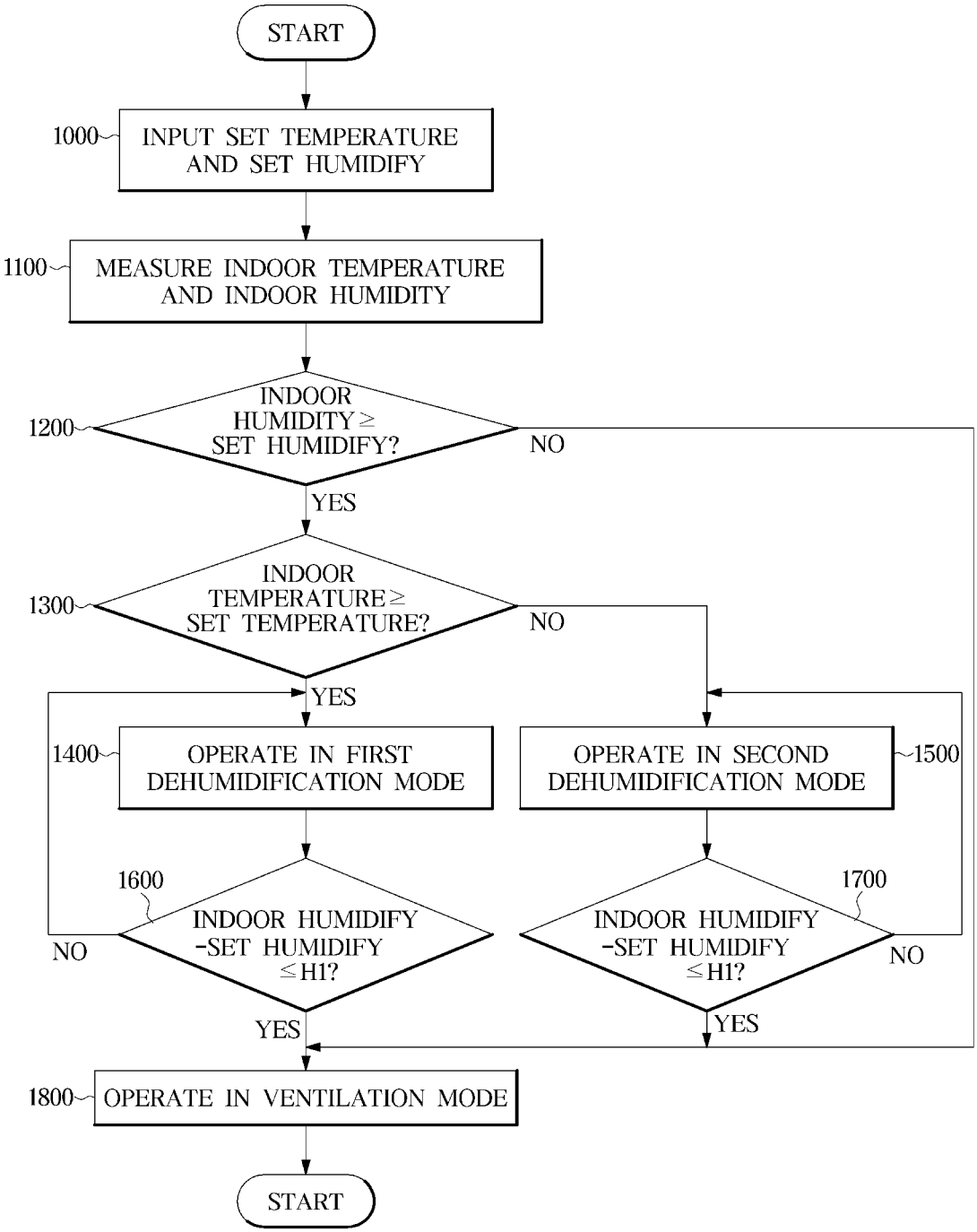
FIG. 4 is a flowchart illustrating a control method of the ventilation system according to one embodiment of the present disclosure.

FIG. 4 is a flowchart illustrating a control method of the ventilation system according to one embodiment of the present disclosure.

Referring to FIG. 4, the ventilation device 100 may determine whether a set temperature value and a set humidify value are input through the inputter 180 (1000), and in response to determining that the set temperature value and the set humidify value are input, the ventilation device 100 may detect an indoor temperature by using the indoor temperature sensor 140, and may detect indoor humidity by using the indoor humidity sensor 150 (1100).

The controller 190 may receive an indoor temperature value from the indoor temperature sensor 140 and may receive an indoor humidity value from the indoor humidity sensor 150. Thereafter, the controller 190 may determine the operation mode and switch the operation mode of the ventilation system 1 based on the indoor temperature, indoor humidity, set temperature, and set humidity.

The controller 190 may determine whether the indoor humidity is greater than the set humidity (1200). In response to the measured indoor humidity being greater than or equal to the input set humidity (hereinafter, referred to as dehumidification mode condition), the controller 190 may determine whether the measured indoor temperature is greater than or equal to the set temperature (1300). That is, in response to the dehumidification mode condition being satisfied, the controller 190 may determine whether the measured indoor temperature is greater than or equal to the set temperature.

In response to the measured indoor humidity being less than the set humidity, the controller 190 may control the ventilation system 1 to be operated in the ventilation mode (1800). Even while the ventilation system 1 is operated in the ventilation mode, the controller 190 may detect the indoor temperature and indoor humidity at predetermined time intervals or in real time, and start anew from step of determining whether the dehumidification mode condition is satisfied based on the detected values.

In response to the measured indoor temperature being greater than or equal to the input set temperature, the controller 190 may control the ventilation system 1 to be operated in the first dehumidification mode (1400). In response to the measured indoor temperature being less than the input set temperature, the controller 190 may control the ventilation system 1 to be operated in the second dehumidification mode (1500).

Even while the ventilation device 100 is operated in the first dehumidification mode or the second dehumidification mode, the controller 190 may detect the indoor humidity at predetermined time intervals or in real time, and compare the indoor humidity with the set humidity (1600, and 1700). In response to a value, which is obtained by subtracting the set humidity value from a current indoor humidity value measured while being operated in the first dehumidification mode or the second dehumidification mode, exceeding an end humidity value H1, the first dehumidification mode or the second dehumidification mode may be maintained until a value, which is obtained by subtracting the set humidity value from the measured indoor humidity value, is less than or equal to the end humidity value H1. The end humidity value H1 may be set to a value of greater than or equal to −5%, but less than or equal to 0% by applying a sensor error. However, the present disclosure is not limited thereto and the end humidity value may be set to another value according to the needs of the user.

In response to the value, which is obtained by subtracting the set humidity value from the current indoor humidity value, being less than or equal to the end humidity value H1, the controller 190 may switch the ventilation device 100 to the ventilation mode (1800). Even while being operated in the ventilation mode, the controller 190 may detect the indoor temperature and indoor humidity at predetermined time intervals or in real time, and start anew from step of determining whether the dehumidification mode condition is satisfied based on the detected values.

However, the present disclosure is not limited thereto. The user may select and determine the first dehumidification mode, the second dehumidification mode, or the ventilation mode through the inputter 180. In this case, the controller 190 may control the ventilation system 1 to be operated in the mode input by the inputter 180 irrespective of the indoor temperature and indoor humidity.

Figure 5:
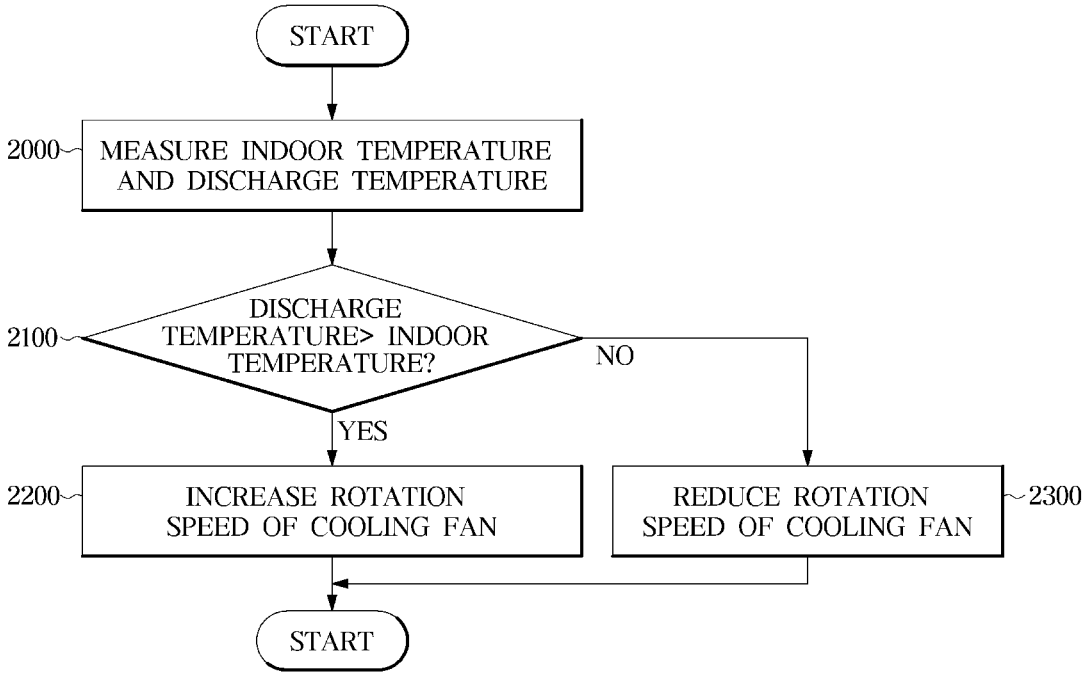
FIG. 5 is a flowchart illustrating a control method of the ventilation system that may be added when the ventilation system is operated in a second dehumidification mode.

FIG. 5 is a flowchart illustrating a control method of the ventilation system that may be added when the ventilation system is operated in the second dehumidification mode.

Referring to FIG. 5, the ventilation device 100 may be operated in the second dehumidification mode to discharge exhaust airflow, which has the same temperature as the indoor temperature, to the indoor space based on the indoor temperature and the discharge temperature. The controller 190 may control the ventilation device 100 to be operated in the second dehumidification mode in which the ventilation device 100 discharges the exhaust airflow having the same temperature as the indoor temperature. That is, the air passing through the second heat exchanger 130 may be heated by the first heat exchanger 120 to have the same discharge temperature as the indoor temperature.

The ventilation device 100 may detect the indoor temperature using the indoor temperature sensor 140 and detect the discharge temperature, which is the temperature of the exhaust airflow discharged into the indoor space, using the discharge temperature sensor 141 (2000).

The controller 190 may receive an indoor temperature value from the indoor temperature sensor 140 and may receive a discharge temperature from the discharge temperature sensor 141. Thereafter, the controller 190 may adjust the rotation speed of the cooling fan 220*a* of the outdoor unit 200 based on the indoor temperature and the discharge temperature.

Particularly, the controller 190 may determine whether the discharge temperature is greater than the indoor temperature (2100). In response to the measured discharge temperature exceeding the measured indoor temperature, the controller 190 may increase the rotation speed of the cooling fan 220*a* (2200). In other words, in response to the measured discharge temperature exceeding the measured indoor temperature, the controller 190 may allow the cooling fan 220*a* to rotate at a speed greater than when the measured discharge temperature does not exceed the measured indoor temperature.

As the rotation speed of the cooling fan 220*a* is increased, the temperature of the refrigerant flowing into the first heat exchanger 120 through the condenser 220 may be reduced, and the discharge temperature of the exhaust airflow, which passes through the first heat exchanger 120 after being heated by the first heat exchanger 120, may also be reduced compared to before the rotation speed of the cooling fan 220*a* is increased.

In response to the measured discharge temperature being less than or equal to the measured indoor temperature, the controller 190 may decrease the rotation speed of the cooling fan 220*a* (2300). In other words, in response to the measured discharge temperature being less than or equal to the measured indoor temperature, the controller 190 may allow the cooling fan 220*a* to rotate at a speed less than when the measured discharge temperature exceeds the measured indoor temperature.

As the rotation speed of the cooling fan 220*a* is reduced, the temperature of the refrigerant flowing into the first heat exchanger 120 through the condenser 220 may be increased, and the discharge temperature of the exhaust airflow, which passes through the first heat exchanger 120 after being heated by the first heat exchanger 120, may also be increased compared to before the rotation speed of the cooling fan 220*a* is reduced.

The controller 190 may detect the indoor temperature and the discharge temperature at predetermined time intervals or in real time, and may adjust the rotation speed of the cooling fan 220*a* at predetermined time intervals or in real time based on the detected values. Accordingly, in response to the temperature of the exhaust airflow being greater than the indoor temperature, the controller 190 may reduce the degree of heating by the first heat exchanger 120 so as to reduce the temperature of the exhaust airflow, and in response to the temperature of the exhaust airflow being less than the indoor temperature, the controller 190 may increase the degree of heating by the first heat exchanger 120 so as to increase the temperature of the exhaust airflow. Therefore, the temperature of the exhaust airflow, which is sucked from the outdoor and then discharged to the indoor space, may be maintained at a temperature substantially equal to the temperature of the indoor air.

The ventilation system illustrated in FIG. 1 may be operated according to the control method illustrated in FIGS. 4 and 5.

Figure 6:
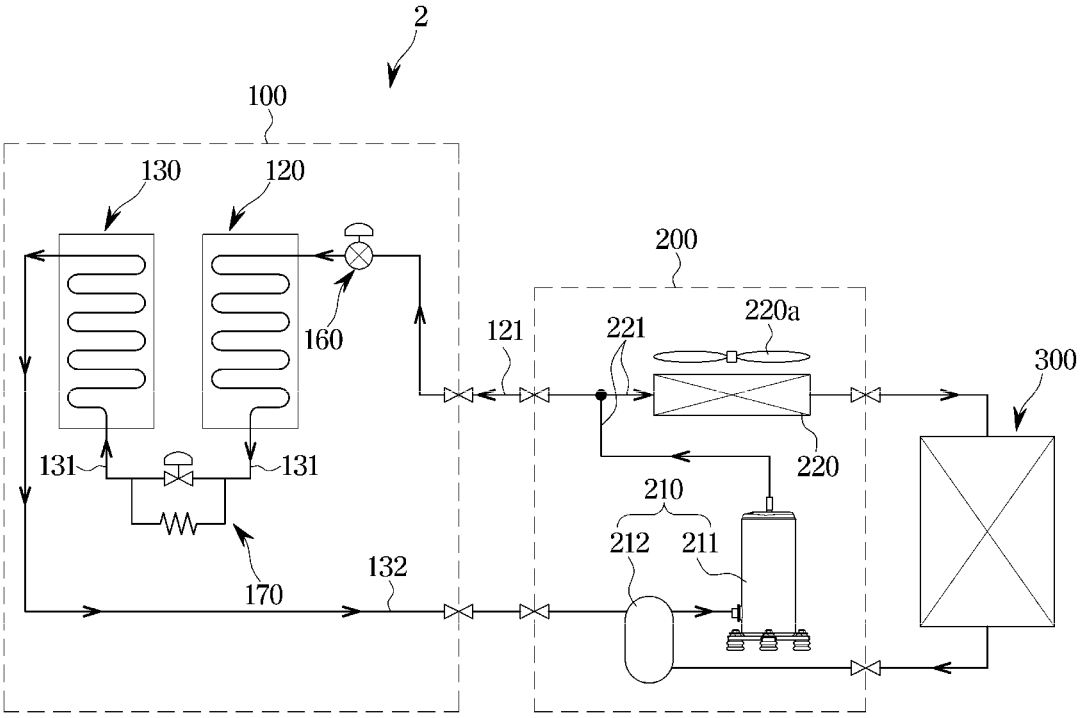
FIG. 6 is a view illustrating a circulation of a refrigerant in an integrated air conditioning system according to one embodiment of the present disclosure.

FIG. 6 is a view illustrating a circulation of a refrigerant in the integrated air conditioning system 2 according to one embodiment of the present disclosure. Descriptions of parts the same as those described above will be omitted.

Referring to FIG. 6, the integrated air conditioning system 2 may include the ventilation device 100, the outdoor unit 200, and a second device 300. The second device 300 may be connected to the outdoor unit 200. The second device 300 may correspond to an 'indoor unit' of the air conditioner. The second device 300 may receive the refrigerant that is discharged from the compressor 210 and condensed in the condenser 220. Hereinafter, the second device 300 is referred to as an 'indoor unit'.

The outdoor unit 200 may also supply the refrigerant to the ventilation device 100. The refrigerant discharged from the condenser 220 of the outdoor unit 200 may be supplied to the ventilation device 100 or the refrigerant discharged from the compressor 210 of the outdoor unit 200 may be supplied to the ventilation device 100.

For example, as illustrated in FIG. 6, the first refrigerant pipe 121 may be branched from the refrigerant pipe 221 connecting the condenser 220 of the outdoor unit 200 to the compressor body 211 of the outdoor unit 200. A refrigerant that does not pass through the condenser 220 of the outdoor unit 200 may flow through the first refrigerant pipe 121, and a high-temperature and high-pressure refrigerant may flow into the first heat exchanger 120. In this case, the first expansion device 160 may or may not expand the refrigerant to a certain extent. Because the refrigerant flowing through the first refrigerant pipe 121 is a non-condensed and high-temperature and high-pressure refrigerant, the first heat exchanger 120 may be operated as a condenser configured to heat air while condensing the refrigerant. That is, regardless of the degree of opening of the first expansion device 160, the ventilation device 100 may be operated in the second dehumidification mode. It should be understood that the ventilation device 100 may be operated in the ventilation mode.

As another example, as described in FIG. 2, the first refrigerant pipe 121 may be directly connected to the condenser 210 of the outdoor unit 200. In this case, the refrigerant condensed in the condenser 220 may be supplied to the ventilation device 100 through the first refrigerant pipe 121.

However, the present disclosure is not limited thereto. For example, a separate condenser (not shown) may be provided on the first refrigerant pipe 121. The refrigerant flowing through the first refrigerant pipe 121 may pass through a condenser (not shown) provided on the first refrigerant pipe 121 and be introduced into the first expansion device 160 in a condensed state, and the ventilation device 100 may be operated in the first dehumidification mode or the second dehumidification mode. It should be understood that the ventilation device 100 may be operated in the ventilation mode.

The refrigerant discharged from the first heat exchanger 120 may be expanded by the second expansion device 170 and then introduced into the second heat exchanger 130. The second heat exchanger 130 may evaporate the refrigerant to condense moisture in the air, thereby dehumidifying the refrigerant. As described above, the ventilation device 100 and the indoor unit 300 may be simultaneously driven using one outdoor unit 200.

Figure 7:
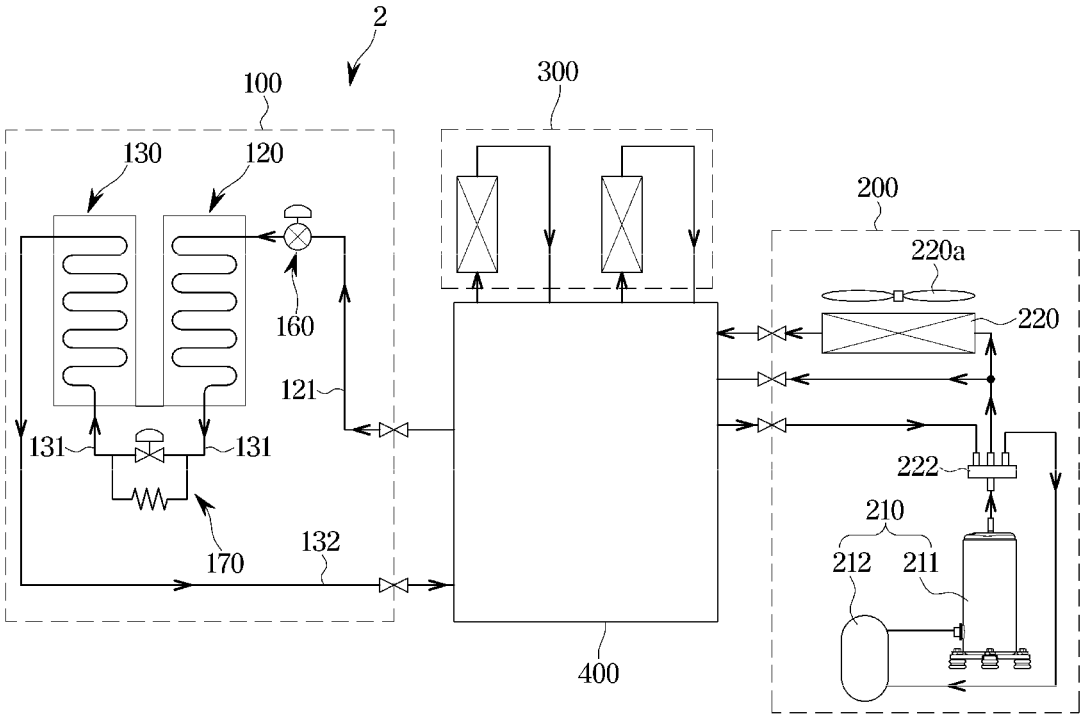
FIG. 7 is a view illustrating a circulation of a refrigerant in an integrated air conditioning system according to another embodiment of the present disclosure.

FIG. 7 is a view illustrating a circulation of a refrigerant in an integrated air conditioning system 2 according to another embodiment of the present disclosure. Descriptions of parts the same as those described above will be omitted.

Referring to FIG. 7, an integrated air conditioning system 2 may further include a refrigerant distributor 400 configured to relay the ventilation device 100 and the outdoor unit 200, and at least second device 300 configured to receive a refrigerant from the outdoor unit 200 through the refrigerant distributor 400. The second device 300 may correspond to 'indoor unit' of an air conditioner.

The refrigerant distributor 400 may receive the refrigerant from the outdoor unit 200, and distribute the refrigerant to the at least on indoor unit 300 and the ventilation device 100 in accordance with a load of each indoor unit 300 and the ventilation device 100. The refrigerant distributor 400 may include a heat recovery cycle. The refrigerant distributor 400 is widely known and used in the art, and a person skilled in the art can easily provide the refrigerant distributor 400 and connect the indoor unit 300 and the ventilation device 100 to the refrigerant distributor.

The outdoor unit 200 connectable to the refrigerant distributor 400 may include the compressor 210, a flow path switching valve 222, and the condenser 220, but is not limited thereto. Accordingly, in order to be connected to the refrigerant distributor 400, the outdoor unit 200 may be changed or configurations thereof may be added at a level that is easy for those skilled in the art.

The ventilation device 100 may be connected to the refrigerant distributor 400. The ventilation device 100 may be connected to the outdoor unit 200 through the refrigerant distributor 400, and may receive the refrigerant from the outdoor unit 200. The first refrigerant pipe 121 and the third refrigerant pipe 132 may be connected to the refrigerant distributor 400.

The refrigerant condensed in the condenser 220 may be supplied to the ventilation device 100 through the first refrigerant pipe 121. The ventilation device 100 may be operated in the first dehumidification mode, the second dehumidification mode, or the ventilation mode depending on whether the first expansion device 160 and/or the second expansion device 170 expand the refrigerant. Accordingly, the integrated air conditioning system 2 may drive the plurality of indoor units 300 and the ventilation device 100 using a single outdoor unit 200.

On the other hand, the operating method of the ventilation device 100 described in FIGS. 1 to 5 may be used in the integrated air conditioning system 2 described in FIGS. 6 and 7.

Figure 8:
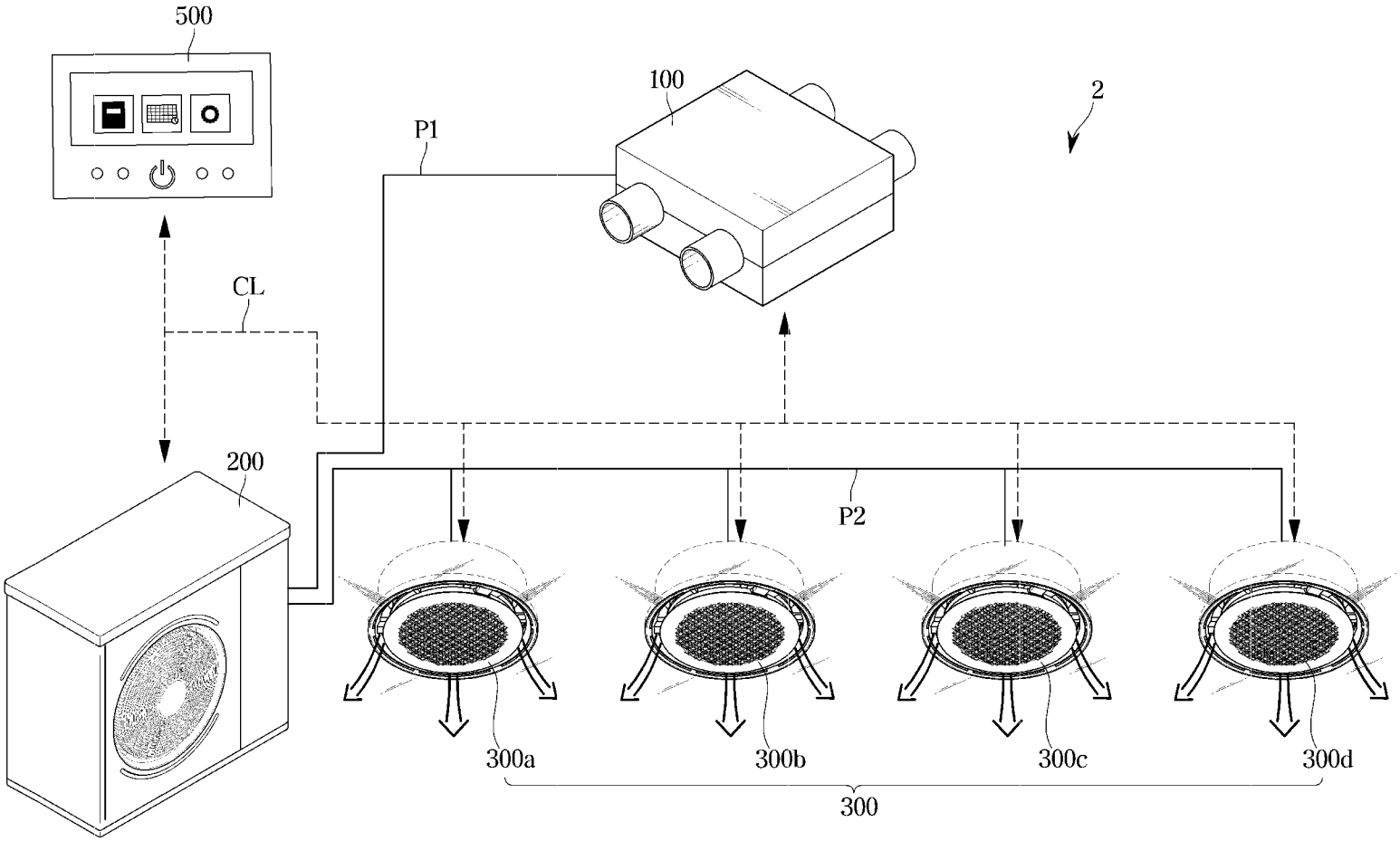
FIG. 8 is a view illustrating a connection relationship between configurations of the integrated air conditioning system illustrated in FIGS. 6 and 7.
Figure 9:
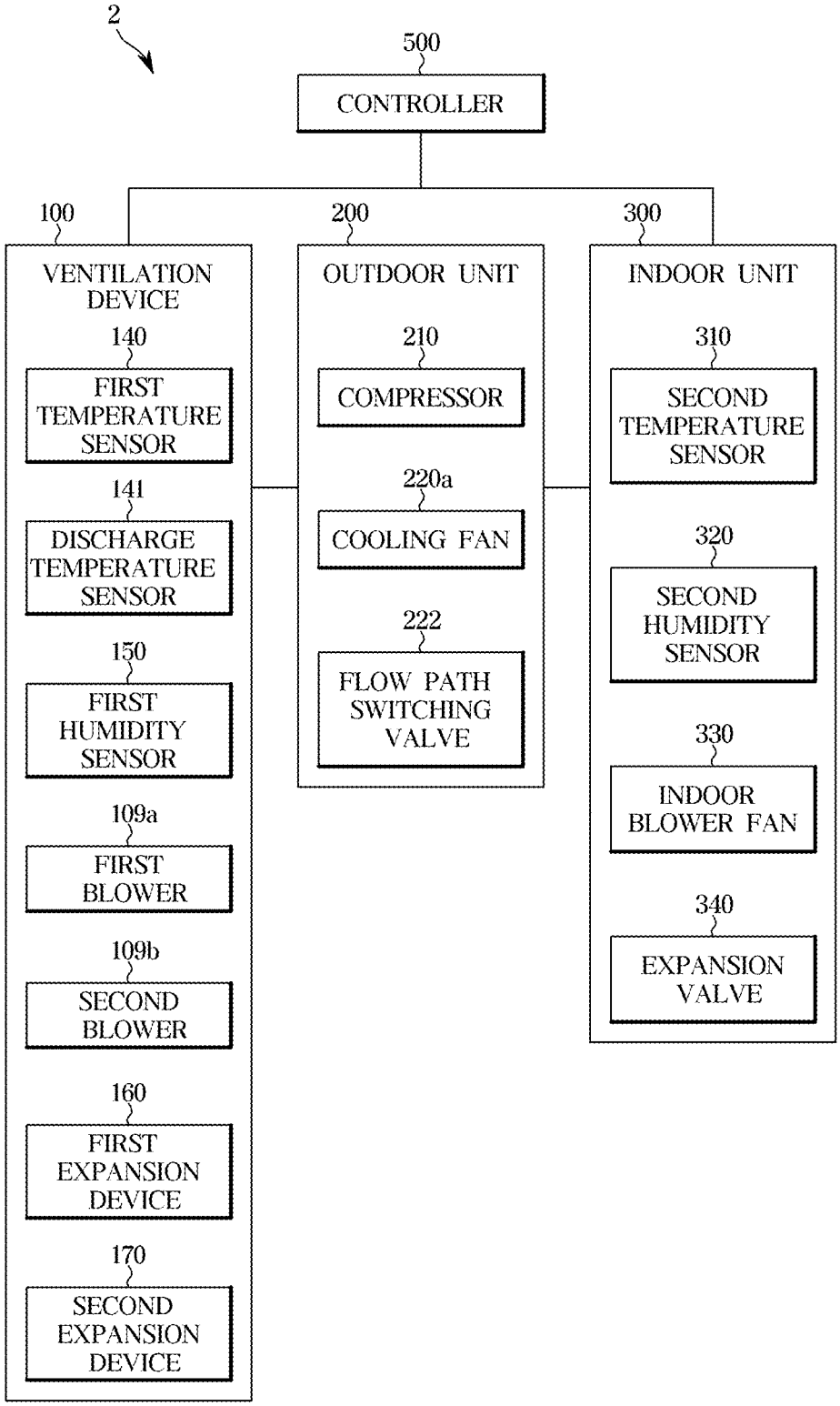
FIG. 9 is a control block diagram illustrating a configuration of the integrated air conditioning system illustrated in FIG. 8.

FIG. 8 is a view illustrating a connection relationship between configurations of the integrated air conditioning system 2 illustrated in FIGS. 6 and 7. FIG. 9 is a control block diagram illustrating a configuration of the integrated air conditioning system 2 illustrated in FIG. 8.

Referring to FIG. 8, the integrated air conditioning system 2 may include the ventilation device 100, the outdoor unit 200, a plurality of indoor units 300: 300*a*, 300*b*, 300*c*, 300*d*, and the controller 500. The ventilation device 100 may be connected to the outdoor unit 200 by a refrigerant pipe P1. The refrigerant pipe P1 may correspond to the first refrigerant pipe 121 described above. The plurality of indoor units 300 may be connected to the outdoor unit 200 through a refrigerant pipe P2. The outdoor unit 200 may supply a refrigerant to each of the plurality of indoor units 300 through the refrigerant pipe P2.

The plurality of indoor units 300 may be respectively installed inside a plurality of different indoor spaces. For example, the plurality of indoor units 300 may be respectively installed in a plurality of offices, a plurality of guest rooms, or a plurality of rooms partitioned inside a building. As each of the plurality of indoor units 300 is operated, air in an indoor space in which each of the plurality of indoor units 300 is installed may be directly conditioned (e.g., cooled).

The ventilation device 100 may be installed in various spaces inside the building. For example, the ventilation device 100 may be installed in a space such as a veranda or a utility room of an apartment. The first inlet 101*a*, the second inlet 101*c*, the first outlet 101*b*, and the second outlet 101*d* provided in the housing 101 of the ventilation device 100 may be connected to a duct, respectively. The duct connected to the second inlet 101*c* and the first outlet 101*b* may extend to the indoor space. For example, a hole communicating with the ventilation device 100 may be provided in a ceiling or wall of the indoor space. The duct connected to the first inlet 101*a* and the second outlet 101*d* may extend to the outdoor space.

An example, in which a single ventilation device 100 and a single outdoor unit 200 are provided, is illustrated, but more than one ventilation device 100 and outdoor unit 200 may be provided. In addition, although an example, in which four indoor units 300 are provided, is illustrated, the number of indoor units 300 is not limited to the illustrated examples. One or more indoor units 300 may be provided.

The controller 500 may be electrically connected to the ventilation device 100, the outdoor unit 200, and the plurality of indoor units 300. The controller 500 may be electrically connected to the ventilation device 100, the outdoor unit 200, and the plurality of indoor units 300 through a communication line CL. The controller 500 may control operations of the ventilation device 100, the outdoor unit 200, and the plurality of indoor units 300.

The controller 500 may obtain a user input, operate the integrated air conditioning system 2 in response to the user input, and display information of the integrated air conditioning system 2. The controller 500 may control the ventilation device 100 and the indoor unit 300 based on the indoor temperature and indoor humidity of the indoor space in which the indoor unit 300 is arranged.

In a high-temperature and high-humidity environment, by operating the indoor unit 300 of the air conditioner to perform the cooling operation, the indoor temperature may be appropriately reduced. However, only by the operation of the indoor unit 300, it may be difficult to properly reduce the indoor humidity at the same time. When a conventional dehumidifier is used to reduce the indoor humidity, a difficulty of increasing the indoor temperature may occur. In addition, the ventilation device 100 may be more effective than the indoor unit 300 in reducing indoor humidity, but it may be difficult to quickly reduce the indoor temperature. In order to ease this difficulty, the ventilation device 100 and the indoor unit 300 may be operated in conjunction with each other. That is, by appropriately controlling the operations of the ventilation device 100 and the indoor unit 300 based on the indoor temperature and indoor humidity, cooling efficiency and dehumidification efficiency may be improved, and energy for cooling and dehumidification may be reduced.

Referring to FIG. 9, the ventilation device 100 may include the first temperature sensor 140, the first humidity sensor 150, the discharge temperature sensor 141, a first blower 109*a*, a second blower 109*b*, the first expansion device 160 and the second expansion device 170, as described above. Further, the ventilation device 100 may include a separate processor and memory for controlling the components of the ventilation device 100. The above-mentioned controller 190 of the ventilation device 100 may include a processor and a memory. Further, the ventilation device 100 may include a communication interface for communicating with the outdoor unit 200 and/or the controller 500. The ventilation device 100 may be operated based on a control signal transmitted from the controller 500 through the communication interface.

The outdoor unit 200 may include the compressor 210, the cooling fan 210*a*, and a flow path switching valve 222. The outdoor unit 200 may also include a separate processor and memory for controlling the compressor 210, the cooling fan 210*a*, and the flow path switching valve 222 of the outdoor unit 200. Further, the outdoor unit 200 may include a communication interface for communicating with the ventilation device 100, the indoor unit 300, and/or the controller 500. The outdoor unit 200 may be operated based on a control signal transmitted from the controller 500 through the communication interface.

The indoor unit 300 may include a second temperature sensor 310, a second humidity sensor 320, an indoor blower fan 330, and an expansion valve 340. The indoor unit 300 may include a separate processor and memory for controlling the second temperature sensor 310, the second humidity sensor 320, the indoor blower fan 330, and the expansion valve 340. Further, the indoor unit 300 may include a communication interface for communicating with the outdoor unit 200 and/or the controller 500. The indoor unit 300 may be operated based on a control signal transmitted from the controller 500 through the communication interface. The indoor unit 300 may include an indoor heat exchanger. The indoor unit 300 may also include an inputter such as a button, and a user input obtained by the inputter of the indoor unit 300 may be transmitted to the controller 500.

A refrigerant supplied from the outdoor unit 200 to the indoor unit 300 may be introduced into the expansion valve 340 provided in the indoor unit 300. The expansion valve 340 may reduce the pressure of the refrigerant and adjust an amount of refrigerant supplied to the indoor heat exchanger to allow sufficient heat exchange to be performed in the indoor heat exchanger. The expansion valve 340 may reduce the pressure of the refrigerant by using the throttling action of the refrigerant in which the pressure of the refrigerant decreases without heat exchange with the outside when the refrigerant passes through a narrow flow path. In order to control the amount of refrigerant passing through the expansion valve 340, an electronic expansion valve (EEV) configured to adjust a degree of opening may be used. As needed, the expansion valve 340 may be arranged inside the outdoor unit 200 instead of the indoor unit 300.

A refrigerant passing through the expansion valve 340 may be introduced into the indoor heat exchanger of the indoor unit 300, and the indoor heat exchanger may evaporate a low-pressure liquid refrigerant during the cooling operation. As the refrigerant absorbs heat while being evaporated, the air passing through the indoor heat exchanger may be cooled, and cold air may be discharged into the indoor space by the operation of the indoor blower fan 330.

The second temperature sensor 310 of the indoor unit 300 may measure the indoor temperature of the indoor space. The second temperature sensor 310 may transmit data about the measured indoor temperature to the controller 500. The second temperature sensor 310 may transmit an electrical signal (voltage or current) corresponding to the measured indoor temperature to the controller 500.

The second humidity sensor 320 of the indoor unit 300 may measure the indoor humidity of the indoor space. The second humidity sensor 320 may transmit the measured indoor humidity data to the controller 500. The second humidity sensor 320 may transmit an electrical signal (voltage or current) corresponding to the measured indoor humidity to the controller 500.

The controller 500 may obtain the indoor temperature from the first temperature sensor 140 provided in the ventilation device 100 or the second temperature sensor 310 provided in the indoor unit 300. Further, the controller 500 may obtain the indoor humidity from the first humidity sensor 150 provided in the ventilation device 100 or the second humidity sensor 320 provided in the indoor unit 300.

The controller 500 may obtain the indoor temperature and indoor humidity by giving priority to the second temperature sensor 310 and the second humidity sensor 320 of the indoor unit 300. While the indoor unit 300 is installed inside the indoor space, the ventilation device 100 may be installed outside the indoor space. Accordingly, the indoor temperature and indoor humidity obtained from the second temperature sensor 310 and the second humidity sensor 320 provided in the indoor unit 300 may be more accurate.

The controller 500 may obtain the indoor temperature and indoor humidity from the first temperature sensor 140 and the first humidity sensor 150 of the ventilation device 100 based on the operation of the indoor unit 300 being stopped.

The controller 500 may control the ventilation device 100 and the indoor unit 300 based on the indoor temperature and indoor humidity. It should be understood that the outdoor unit 200 is controlled for the operation of the ventilation device 100 and the indoor unit 300.

The controller 500 may set a target temperature and target humidity of the indoor space based on a user input. The target temperature and target humidity may be automatically set based on the outdoor environment and/or the indoor environment. For example, in order to create an indoor space in which a user can feel comfortable on a hot summer day, the target temperature may be set to 24° C., and the target humidity may be set to 40%. The target temperature and target humidity may vary depending on the season and outdoor environment. The target temperature may have the same meaning as the set temperature described in FIG. 4, and the target humidity may have the same meaning as the set humidity described in FIG. 4.

The controller 500 may operate the indoor unit 300 based on the indoor temperature being greater than or equal to a predetermined reference temperature. That is, the indoor unit 300 may perform the cooling operation to reduce the indoor temperature. In response to the indoor temperature being greater than or equal to the reference temperature, the controller 500 may operate the indoor unit 300 to rapidly cool the indoor space. For example, the reference temperature may be 28° C. The reference temperature may be predetermined by applying external environmental factors, or may be determined by a user. The target temperature may be set to be less than the reference temperature.

In response to the indoor temperature reaching a stop temperature, which is less than the target temperature by a predetermined first temperature value, during the cooling operation is performed by the indoor unit 300, the integrated air conditioning system 2 may stop the operation of the indoor unit 300 or may operate the indoor unit 300 in a temperature maintenance mode. For example, based on the indoor temperature reaching the stop temperature that is 1° C. less than the target temperature, the integrated air conditioning system 2 may stop the operation of the indoor unit 300 or operate the indoor unit 300 in the temperature maintenance mode. The first temperature value may be changed according to design. Alternatively, the first temperature value may be set based on a user input. In other words, in response to the indoor temperature reaching the stop temperature, the integrated air conditioning system 2 may stop the flow of refrigerant from the outdoor unit 200 to the indoor unit 300 or reduce the amount of refrigerant flowing into the indoor unit 300. Stopping the flow of the refrigerant to the indoor unit 300 may be performed by turning off the compressor 210 of the outdoor unit 200 or closing the expansion valve 340. Reducing the amount of refrigerant flowing into the indoor unit 300 may be performed by reducing the rotation speed of the compressor 210 or adjusting the degree of opening of the expansion valve 340.

In order for the indoor temperature to follow the target temperature, the integrated air conditioning system 2 may control the on/off of the compressor 210, adjust the rotation speed and frequency of the compressor 210, and/or control the expansion valve 340.

In addition, based on the indoor humidity being greater than or equal to a predetermined reference humidity, the controller 500 may operate the ventilation device 100 until the indoor humidity reaches the target humidity. That is, the ventilation device 100 may perform the dehumidification operation to reduce the indoor humidity. In response to the indoor humidity being greater than or equal to the reference humidity, the controller 500 may operate the ventilation device 100 to quickly reduce the humidity of the indoor space. For example, the reference humidity may be 60%. The reference humidity may be predetermined by applying external environmental factors, or may be determined by a user. The target humidity may be set to be less than the reference humidity.

The ventilation device 100 sucks air in the indoor space, and discharges the sucked air to the outdoor space, and supplies air, from which moisture is removed, to the indoor space, thereby reducing the absolute humidity of the indoor space. In other words, by reducing the absolute humidity of the indoor space, it is possible to perform more efficient dehumidification in comparison with a case in which the relative humidity of the indoor space is reduced by simply supplying relatively warm air to the indoor space without removing moisture in the air.

The controller 500 may operate the ventilation device 100 in the first dehumidification mode to reduce both the indoor temperature and the indoor humidity based on the indoor temperature being greater than the target temperature and the indoor humidity being greater than the target humidity. As described above, in the first dehumidification mode, the ventilation device 100 may control the first expansion device 160 to expand the refrigerant flowing from the outdoor unit 200 to the first heat exchanger 120. In the first dehumidification mode, the second expansion device 170 provided between the first heat exchanger 120 and the second heat exchanger 130 may be controlled so as not to expand the refrigerant.

During the ventilation device 100 is operated in the first dehumidification mode, the refrigerant may be evaporated by absorbing heat from the air while flowing through the first heat exchanger 120 and the second heat exchanger 130. Accordingly, the cooled air may be discharged into the indoor space. At the same time, moisture contained in the air passing through the first heat exchanger 120 and the second heat exchanger 130 may be condensed and removed, and thus dry air may be discharged into the indoor space.

Meanwhile, the second expansion device 170 may be controlled to expand the refrigerant. The first dehumidification mode will be referred to as 'cooling and dehumidification mode'.

Based on the indoor temperature being less than or equal to the target temperature and the indoor humidity being greater than the target humidity, the controller 500 may operate the ventilation device 100 in the second dehumidification mode for maintaining the indoor temperature and reducing the indoor humidity. For example, in response to the indoor temperature reaching the stop temperature, which is less than the target temperature by the predetermined first temperature value, the ventilation device 100 may be operated in the second dehumidification mode. As described above, in the second dehumidification mode, the ventilation device 100 may control the second expansion device 170 to expand the refrigerant flowing from the first heat exchanger 120 to the second heat exchanger 130. In the second dehumidification mode, the first expansion device 160 may be controlled so as not to expand the refrigerant.

During the ventilation device 100 is operated in the second dehumidification mode, the refrigerant may be condensed while flowing through the first heat exchanger 120, expanded in the second expansion device 170, and then introduced into the second heat exchanger 130. Because air passes sequentially through the second heat exchanger 130 and the first heat exchanger 120, moisture contained in the air may be condensed and removed in the second heat exchanger 130, and the air, which is cooled by passing through the second heat exchanger 130, may be heated by passing through the first heat exchanger 120. The ventilation device 100 operated in the second dehumidification mode may discharge dry air having the same or similar temperature to the indoor temperature to the indoor space. The first dehumidification mode may be referred to as a 'constant temperature dehumidification mode'.

The controller 500 may operate the ventilation device 100 in a ventilation mode for maintaining both the indoor temperature and the indoor humidity based on the indoor temperature being less than or equal to the target temperature and the indoor humidity being less than or equal to the target humidity. As described above, in the ventilation mode, the ventilation device 100 may control the first expansion device 160 to block the flow of the refrigerant from the outdoor unit 200 to the first heat exchanger 120 of the ventilation device 100.

Because the first heat exchanger 120 and the second heat exchanger 130 are connected in series, the refrigerant may not be supplied to the second heat exchanger 130 unless the refrigerant is supplied to the first heat exchanger 120. That is, during the ventilation device 100 is operated in the ventilation mode, air discharged from the ventilation device 100 to the indoor space may be air that is heat-exchanged only by the total heat exchanger 110. A temperature of the air heat-exchanged by the total heat exchanger 110 may be the same as or similar to the indoor temperature. In addition, some of the moisture contained in the sucked outdoor air may be removed even by the total heat exchanger 110.

The operation mode of the ventilation device 100 may be automatically switched to the first dehumidification mode, the second dehumidification mode, or the ventilation mode based on the indoor temperature and indoor humidity. The indoor unit 300 may also be automatically turned on or off based on the indoor temperature. As described above, by operating the ventilation device 100 and the indoor unit 300 in conjunction with each other based on the indoor temperature and indoor humidity, cooling efficiency and dehumidification efficiency may be improved, and energy for cooling and dehumidification may be reduced.

Figure 10:
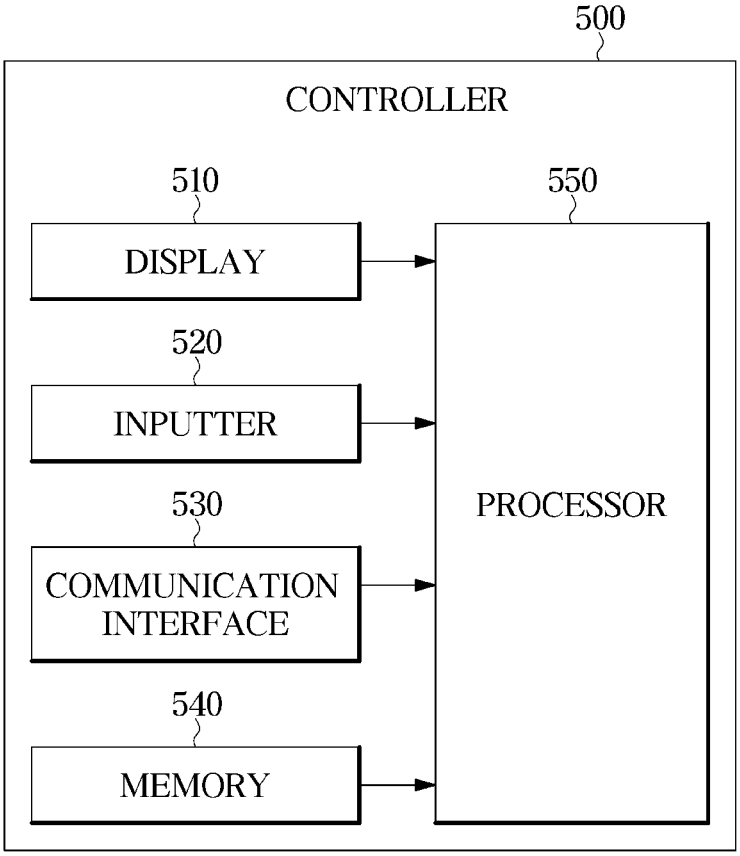
FIG. 10 is a control block diagram illustrating a configuration of a controller.

FIG. 10 is a control block diagram illustrating a configuration of the controller.

Referring to FIG. 10, the controller 500 may include a display 510, an inputter 520, a communication interface 530, and a memory 540, and may include a processor 550 electrically connected thereto. The controller 500 may provide a user interface for interaction between the integrated air conditioning system 2 and a user.

The display 510 may display information about a status and/or operation of the integrated air conditioning system 2. The display 510 may display information input by the user or information provided to the user as various screens. The display 510 may display information related to the operation of the integrated air conditioning system 2 as at least one of an image or text. Further, the display 51 may display a graphic user interface (GUI) configured to allow the integrated air conditioning system 2 to be controlled. That is, the display 510 may display a User Interface (UI) element such as an icon.

The display 510 may include various types of display panels. For example, the display 540 may include a Liquid Crystal Display (LCD) panel, a Light Emitting Diode (LED) panel, an Organic Light Emitting Diode (OLED) panel, or a micro-LED panel.

The display 510 may be implemented as a touch display. The touch display may include a display panel configured to display an image and a touch panel configured to receive a touch input. The display panel may convert the image data received by the processor 550 into an optical signal that may be viewed by a user. The touch panel may identify the user's touch input and provide an electrical signal corresponding to the received touch input to the processor 550.

The inputter 520 of the controller 500 may output an electrical signal (voltage or current) corresponding to a user input to the processor 550. The inputter 520 may include various buttons and a dial. When the display 510 is provided as a touch display, a separate inputter 520 may not be provided in the controller 500. That is, the controller 500 may obtain a user input. For example, the controller 500 may obtain a user input for setting a target temperature and a target humidity, a user input for turning on or off each of the ventilation device 100 and the indoor unit 300, and a user input for setting each operation mode of the ventilation device 100 and the indoor unit 300.

The communication interface 530 may communicate with the ventilation device 100, the outdoor unit 200, and the indoor unit 300. The communication interface 530 of the controller 500 may be connected to each of a communication interface of the ventilation device 100, the outdoor unit 200, and the indoor unit 300 through the communication line CL. The controller 500 may transmit a control signal to the ventilation device 100, the outdoor unit 200, and the indoor unit 300 through the communication interface 530.

Further, the communication interface 530 may include a wired communication module and/or a wireless communication module for communicating with an external device (e.g., a mobile device, and a computer). The wired communication module may communicate with an external device through a wide area network such as the Internet, and the wireless communication module may communicate with the external device through an access point connected to the wide area network. Accordingly, a user can remotely control the integrated air conditioning system 2.

The memory 540 may memorize/store various types of information necessary for the operation of the integrated air conditioning system 2. The memory 540 may store instructions, applications, data and/or programs necessary for the operation of the integrated air conditioning system 2. For example, the memory 540 may store data about the reference temperature and reference humidity for determining the operation of the ventilation device 100 and the indoor unit 300.

The memory 540 may include a volatile memory such as a static random access memory (S-RAM) or a dynamic random access memory (D-RAM) for temporarily storing data. In addition, the memory 540 may include a non-volatile memory such as a Read Only Memory (ROM), an Erasable Programmable Read Only Memory (EPROM), or an Electrically Erasable Programmable Read Only Memory (EEPROM) for storing data for a long period of time.

The processor 550 may generate a control signal for controlling the operation of the integrated air conditioning system 2 based on instructions, applications, data and/or programs stored in the memory 540. The processor 550 may include a logic circuit and an arithmetic circuit corresponding to hardware. The processor 550 may process data according to a program and/or instructions provided from the memory 540, and generate a control signal according to the processing result. The memory 540 and the processor 550 may be implemented as one control circuit or a plurality of circuits.

Meanwhile, the components of the ventilation device 100, the outdoor unit 200, the indoor unit 300, and the controller 500 are not limited to those described with reference to FIGS. 9 and 10. Some of the components of the ventilation device 100, the outdoor unit 200, the indoor unit 300, and the controller 500 described in FIGS. 9 and 10 may be omitted. In addition, each of the ventilation device 100, the outdoor unit 200, the indoor unit 300, and the controller 500 may further include other components.

Figure 11:
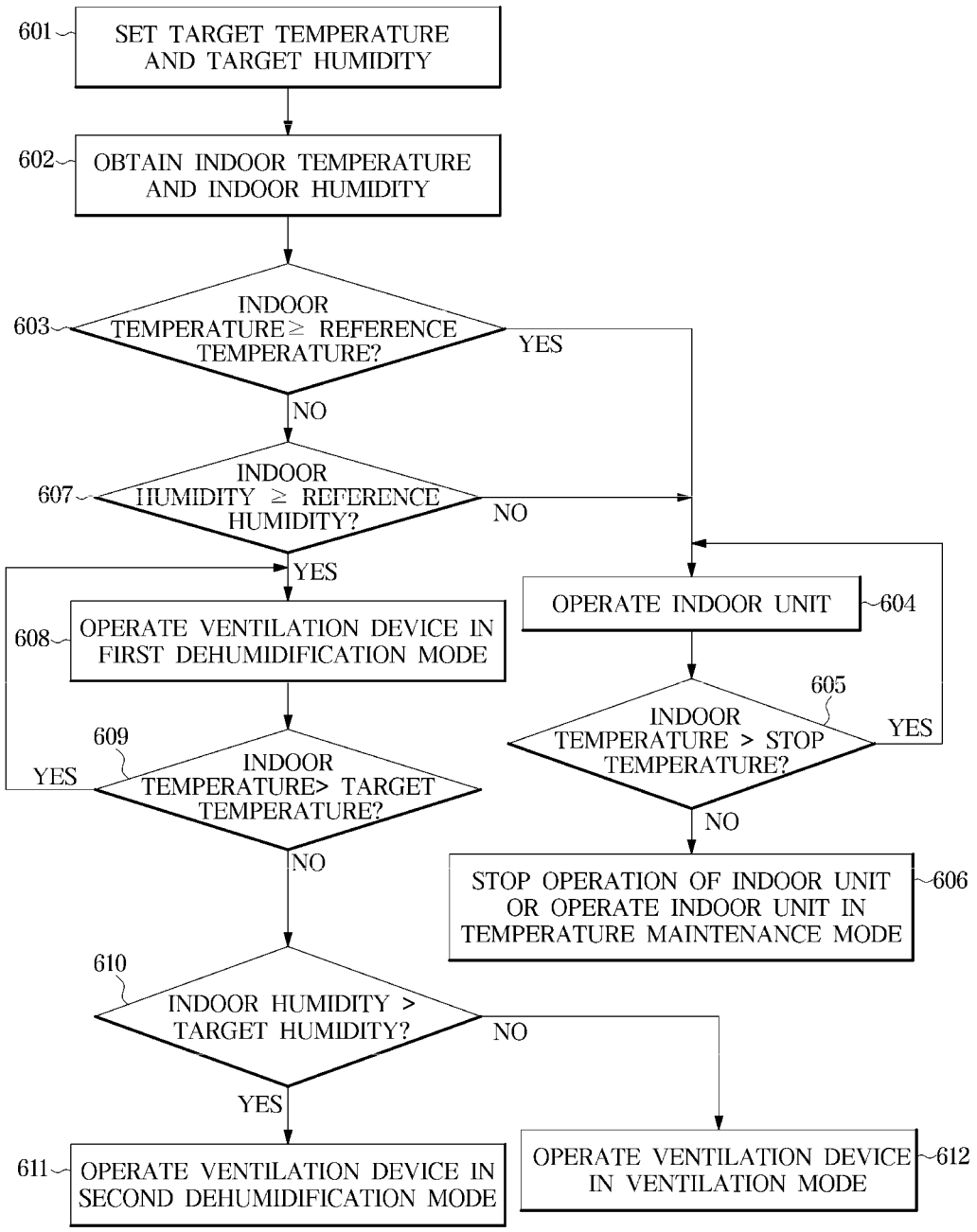
FIG. 11 is a flow chart illustrating an example of a control method of the integrated air conditioning system illustrated in FIGS. 8 and 9.

FIG. 11 is a flow chart illustrating an example of a control method of the integrated air conditioning system illustrated in FIGS. 8 and 9.

Referring to FIG. 11, the controller 500 of the integrated air conditioning system 2 may set the target temperature and the target humidity of the indoor space based on the user input (601). The target temperature and target humidity may be automatically set based on the outdoor environment and/or the indoor environment. When there is a plurality of indoor spaces, and a plurality of indoor units 300 is installed in the plurality of indoor spaces, the controller 500 may set the target temperature and the target humidity for each of the plurality of indoor spaces.

The controller 500 may obtain the indoor temperature from the first temperature sensor 140 provided in the ventilation device 100 or the second temperature sensor 310 provided in the indoor unit 300. In addition, the controller 500 may obtain the indoor humidity from the first humidity sensor 150 provided in the ventilation device 100 or the second humidity sensor 320 provided in the indoor unit 300 (602). When there is a plurality of indoor spaces, the controller 500 may obtain the indoor temperature and indoor humidity of each of the plurality of indoor spaces.

The controller 500 may determine whether the indoor temperature is greater than a predetermined reference temperature (603). The controller 500 may operate the indoor unit 300 based on the indoor temperature being greater than or equal to the predetermined reference temperature (604). The indoor unit 300 may perform the cooling operation to reduce the indoor temperature. The controller 500 may continuously obtain the indoor temperature from the second temperature sensor 310 of the indoor unit 300.

In response to the indoor temperature reaching the stop temperature, which is less than the target temperature by the predetermined first temperature value, during the cooling operation is performed by the indoor unit 300, the controller 500 may stop the operation of the indoor unit 300 or may operate the indoor unit 300 in the temperature maintenance mode (605 and 606). For example, based on the indoor temperature reaching the stop temperature that is 1° C. less than the target temperature, the integrated air conditioning system 2 may stop the operation of the indoor unit 300 or operate the indoor unit 300 in the temperature maintenance mode. The first temperature value may be changed according to design. Alternatively, the first temperature value may be set based on a user input.

The cooling efficiency may be improved by using the stop temperature in relation to the operation of the indoor unit 300. For example, when the operation of the indoor unit 300 is stopped in response to the indoor temperature reaching the target temperature, the indoor temperature may become greater than the target temperature again within a short period of time, thereby reducing cooling efficiency. Determining whether to stop or maintain the operation of the indoor unit 300 using the stop temperature less than the target temperature may be more effective to maintain the indoor temperature to be less than or equal to the target temperature. In addition, whether or not to operate the indoor unit 300 in response to the indoor temperature reaching the stop temperature may be determined based on a load of the indoor temperature, which will be described later, thereby improving power efficiency.

In other words, in response to the indoor temperature reaching the stop temperature, the integrated air conditioning system 2 may stop the flow of refrigerant from the outdoor unit 200 to the indoor unit 300 or reduce the amount of refrigerant flowing into the indoor unit 300. Stopping the flow of the refrigerant to the indoor unit 300 may be performed by turning off the compressor 210 of the outdoor unit 200 or closing the expansion valve 340. Reducing the amount of refrigerant flowing into the indoor unit 300 may be performed by reducing the rotation speed of the compressor 210 or adjusting the degree of opening of the expansion valve 340.

In order for the indoor temperature to follow the target temperature, the integrated air conditioning system 2 may control the on/off of the compressor 210, adjust the rotation speed and frequency of the compressor 210, and/or adjust the degree of opening of the expansion valve 340.

The indoor humidity may be continuously measured by the first humidity sensor 150 of the ventilation device 100 or the second humidity sensor 320 of the indoor unit 300. That is, the indoor humidity may be continuously measured while the indoor unit 300 performs the cooling operation, and the operation of the ventilation device 100 may be determined based on the indoor humidity. The controller 500 may operate the ventilation device 100 based on the indoor humidity being greater than or equal to the predetermined reference humidity. That is, the ventilation device 100 may perform the dehumidification operation to reduce the indoor humidity. The controller 500 may operate the ventilation device 100 until the indoor humidity reaches the target humidity that is less than the reference humidity.

The controller 500 may operate the ventilation device 100 in the first dehumidification mode for reducing both the indoor temperature and the indoor humidity based on the indoor temperature being greater than the target temperature and the indoor humidity being greater than the target humidity (607 and 608). During the ventilation device 100 is operated in the first dehumidification mode, the outdoor air sucked into the ventilation device 100 may be cooled, and moisture contained in the suctioned outdoor air may be removed. Accordingly, the cooled and dehumidified air may be discharged to the indoor space, and thus the indoor temperature and indoor humidity may be reduced.

The controller 500 may continuously monitor the indoor temperature and indoor humidity. During the indoor unit 300 is operated, the controller 500 may obtain the indoor temperature from the second temperature sensor 310 of the indoor unit 300, and obtain the indoor humidity from the second humidity sensor 320 of the indoor unit 300. Based on the operation of the indoor unit 300 being stopped, the controller 500 may obtain the indoor temperature from the first temperature sensor 140 of the ventilation device 100 and obtain the indoor humidity from the first humidity sensor 150 of the ventilation device 100.

The controller 500 may operate the ventilation device 100 in the second dehumidification mode for maintaining the indoor temperature and reducing the indoor humidity based on the indoor temperature being less than or equal to the target temperature and the indoor humidity being greater than the target humidity. (609, 610, and 611). During the ventilation device 100 is operated in the second dehumidification mode, the ventilation device 100 may discharge dry air having a temperature equal to or similar to the indoor temperature to the indoor space. Accordingly, the indoor humidity may be reduced while the indoor temperature is maintained.

The controller 500 may operate the ventilation device 100 in the ventilation mode for maintaining both the indoor temperature and the indoor humidity based on the indoor temperature being less than or equal to the target temperature and the indoor humidity being less than or equal to the target humidity (612). During the ventilation device 100 is operated in the ventilation mode, the sucked outdoor air may exchange heat with the sucked indoor air by the total heat exchanger 110. The temperature and humidity of the air heat-exchanged by the total heat exchanger 110 may be the same as or similar to the indoor temperature and indoor humidity, respectively.

The operation mode of the ventilation device 100 may be automatically switched to the first dehumidification mode, the second dehumidification mode, or the ventilation mode based on the indoor temperature and indoor humidity. The indoor unit 300 may also be automatically turned on or off based on the indoor temperature.

Figure 12:
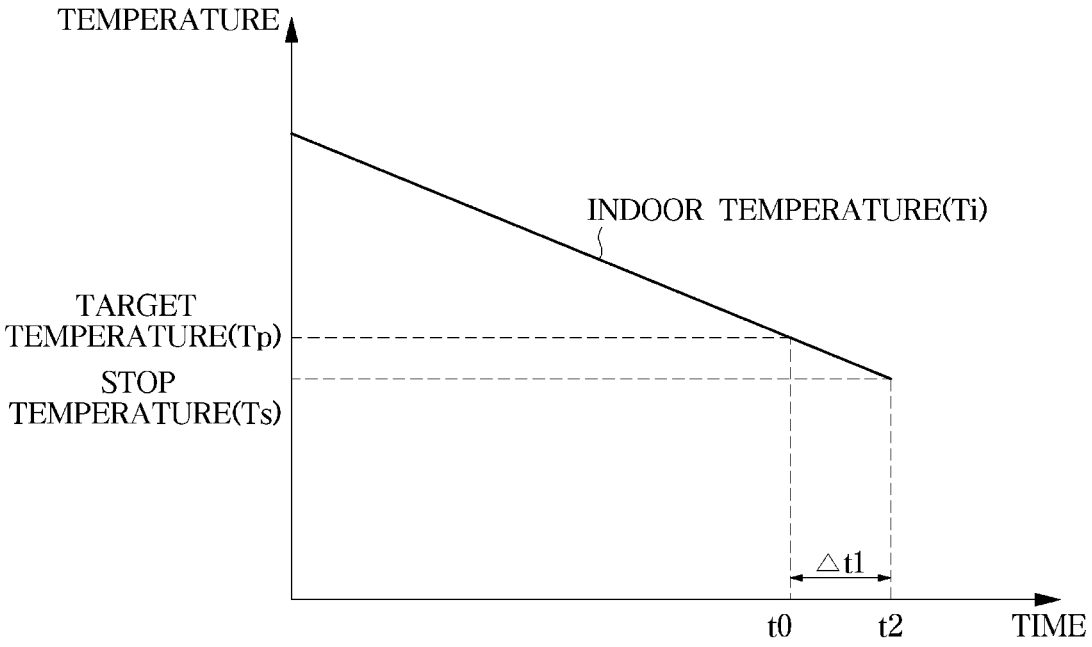
FIG. 12 is a graph illustrating an indoor temperature that is reduced according to a cooling operation of an indoor unit.
Figure 13:
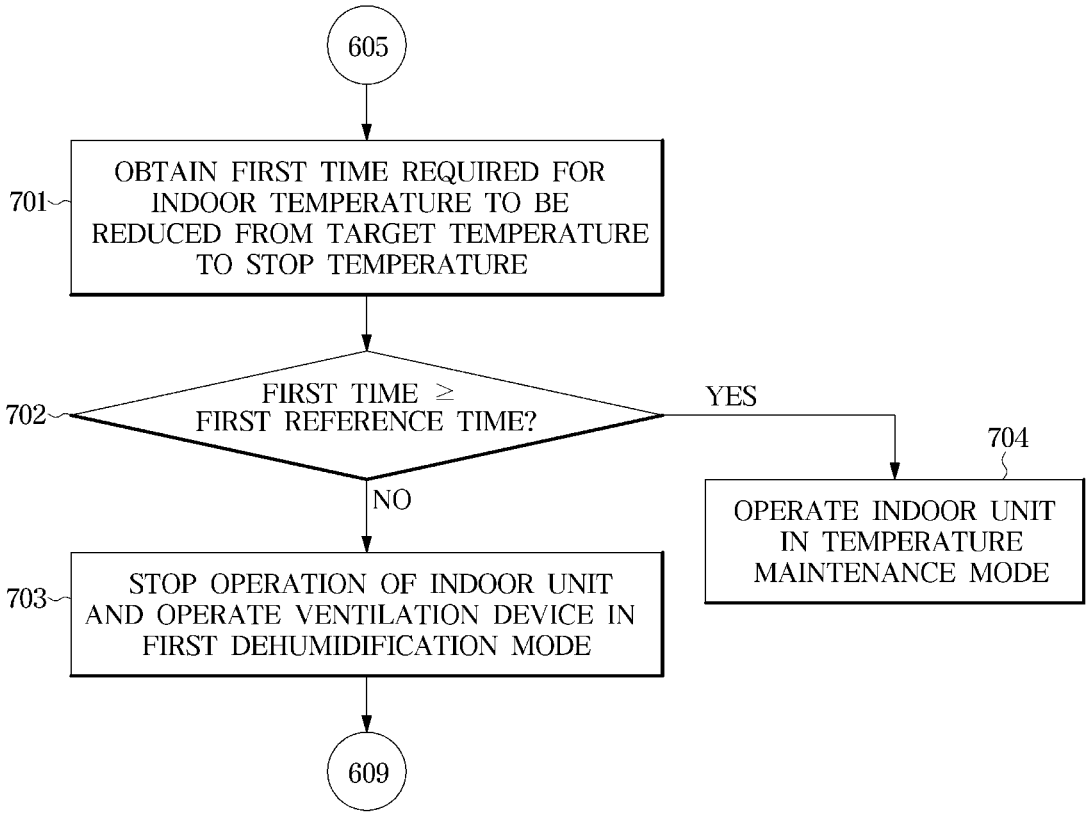
FIG. 13 is a flow chart illustrating a method for determining to stop or to maintain an operation of the indoor unit in details.

FIG. 12 is a graph illustrating the indoor temperature that is reduced according to the cooling operation of the indoor unit. FIG. 13 is a flow chart illustrating a method for determining to stop or to maintain the operation of the indoor unit in details.

The indoor temperature is reduced according to the cooling operation of the indoor unit 300. However, a rate of decrease of the indoor temperature may vary depending on the load of the indoor temperature. The indoor temperature is affected by heat generated by objects placed in the indoor space. For example, household appliances such as televisions, refrigerators, computers and clothes dryers placed indoors may radiate heat. People indoors also radiate heat, and as the number of people increases, an amount of heat radiated from the people may increase. In addition, heat may be radiated when heating cooking is performed indoors by a cooking appliance such as a gas stove or an electric stove.

That is, the load of the indoor temperature may vary depending on the room condition. In response to the load of the indoor temperature being large, the rate of decrease of the indoor temperature by the operation of the indoor unit 300 may be reduced. When the load of the indoor temperature is large, it may be difficult to maintain the indoor temperature only by the operation of the ventilation device 100. Conversely, when the load of the indoor temperature is small, the rate of decrease of the indoor temperature by the operation of the indoor unit 300 may be increased. The load of the indoor temperature may be defined as a rate of change of the indoor temperature. When the load of the indoor temperature is small, it is possible to maintain the indoor temperature only by the operation of the ventilation device 100. As described above, based on the indoor temperature Ti reaching the stop temperature Ts less than the target temperature Tp, the integrated air conditioning system 2 may determine to stop the operation of the indoor unit 300 or to maintain the indoor temperature by the indoor unit 300.

In response to the indoor temperature Ti reaching the stop temperature Ts less than the target temperature Tp (605), the controller 500 of the integrated air conditioning system 2 may obtain and/or calculate a first time Δt1 that is required for the indoor temperature Ti to be reduced from the target temperature Tp to the stop temperature Ts (701). The controller 500 may identify and/or detect a time t0 at which the indoor temperature Ti reaches the target temperature Tp and a time t2 at which the indoor temperature Ti reaches the stop temperature Ts. The controller 500 may calculate a time interval between the time t0 and the time t2 as the first time Δt1.

Based on the first time Δt1 required for the indoor temperature Ti to be reduced from the target temperature Tp to the stop temperature Ts, stopping the operation of the indoor unit 300 or maintaining the temperature by the indoor unit 300 may be determined. In addition, whether to operate the ventilation device 100 may be determined together.

For example, based on the first time Δt1, which is required for the indoor temperature Ti to be reduced from the target temperature Tp to the stop temperature Ts, being less than a first predetermined reference time (702), the controller 500 of the integrated air conditioning system 2 may stop the operation of the indoor unit 300 and operate the ventilation device 100. The ventilation device 100 may be operated in the first dehumidification mode (703). The first reference time may be 3 minutes. The first reference time may be changed according to design. Alternatively, the first reference time may be set based on a user input.

That the first time Δt1 is less than the first reference time may mean that the rate of decrease of the indoor temperature Ti is greater than a reference rate of decrease. In this case, the controller 500 may determine that the load of the indoor temperature is small and that it is possible to maintain the indoor temperature by the ventilation device 100. The rotation speed of the compressor 210 required for the operation of the ventilation device 100 is less than the rotation speed of the compressor 210 required for the operation of the indoor unit 300. Therefore, when the temperature of the indoor load is relatively small, the power consumption may be reduced by switching the operation of the indoor unit 300 to the operation of the ventilation device 100.

Conversely, based on the first time Δt1, which is required for the indoor temperature Ti to be reduced from the target temperature Tp to the stop temperature Ts, being greater than or equal to the first predetermined reference time (702), the controller 500 of the integrated air conditioning system 2 may operate the indoor unit 300 in the temperature maintenance mode (704). That the first time Δt1 is greater than or equal to the first predetermined reference time may mean that the rate of decrease of the indoor temperature Ti is less than the reference rate of decrease. This may indicate that the load of the indoor temperature is relatively large.

When the load of the indoor temperature is relatively large, it may be impossible to maintain the indoor temperature only by the operation of the ventilation device 100, and the operation of the indoor unit 300 may be required to maintain the indoor temperature. Therefore, the controller 500 of the integrated air conditioning system 2 may continuously operate the indoor unit 300 based on the first time Δt1, which is required for the indoor temperature Ti to be reduced from the target temperature Tp to the stop temperature Ts, being greater than the first predetermined reference time. In this case, the indoor unit 300 may be operated in the temperature maintenance mode.

In order to operate the indoor unit 300 in the temperature maintenance mode, the controller 500 may repeat turning on/off of the compressor 210, adjust the rotation speed and frequency of the compressor 210, or adjust the degree of opening of the expansion valve 340. For example, in response to the indoor temperature Ti reaching the stop temperature Ts, the rotation speed and frequency of the compressor 210 may be reduced, and in response to the indoor temperature Ti increasing and reaching the target temperature Tp, the rotation speed and frequency of the compressor 210 may be increased. Further, the flow rate of the refrigerant flowing into the indoor unit 300 may be adjusted by adjusting the degree of opening of the expansion valve 340. In response to the indoor temperature Ti reaching the stop temperature Ts, the flow rate of the refrigerant flowing into the indoor unit 300 may be reduced, and then, in response to the indoor temperature Ti increasing and reaching the target temperature Tp, the flow rate of the refrigerant flowing into the indoor unit 300 may be increased. The indoor temperature may follow the target temperature by the operation of the indoor unit 300.

Figure 14:
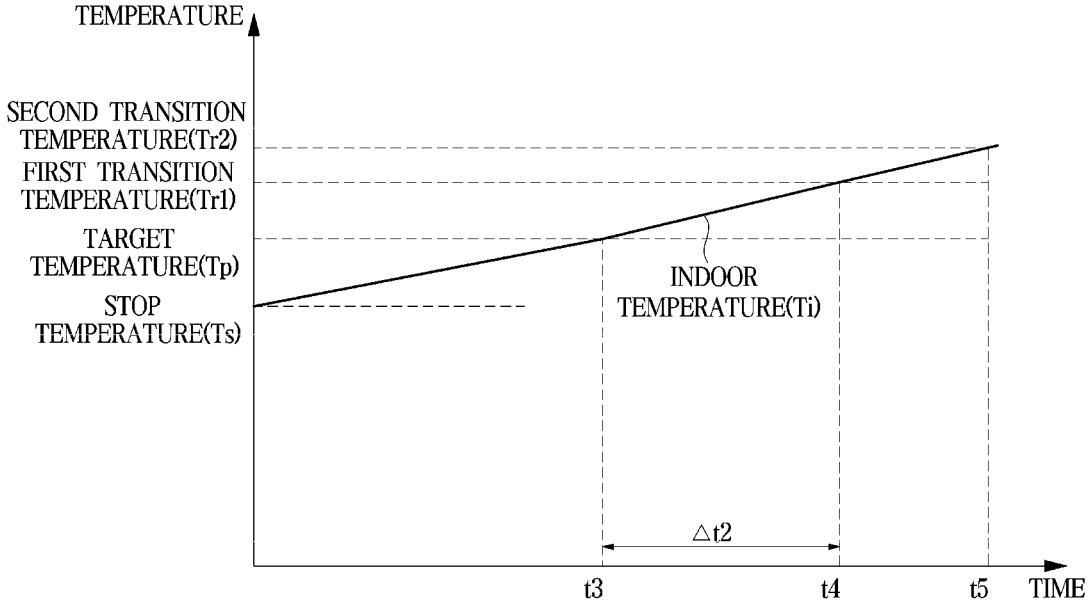
FIG. 14 is a graph illustrating an indoor temperature that is increased due to a load of an indoor temperature during the operation of a ventilation device.
Figure 15:
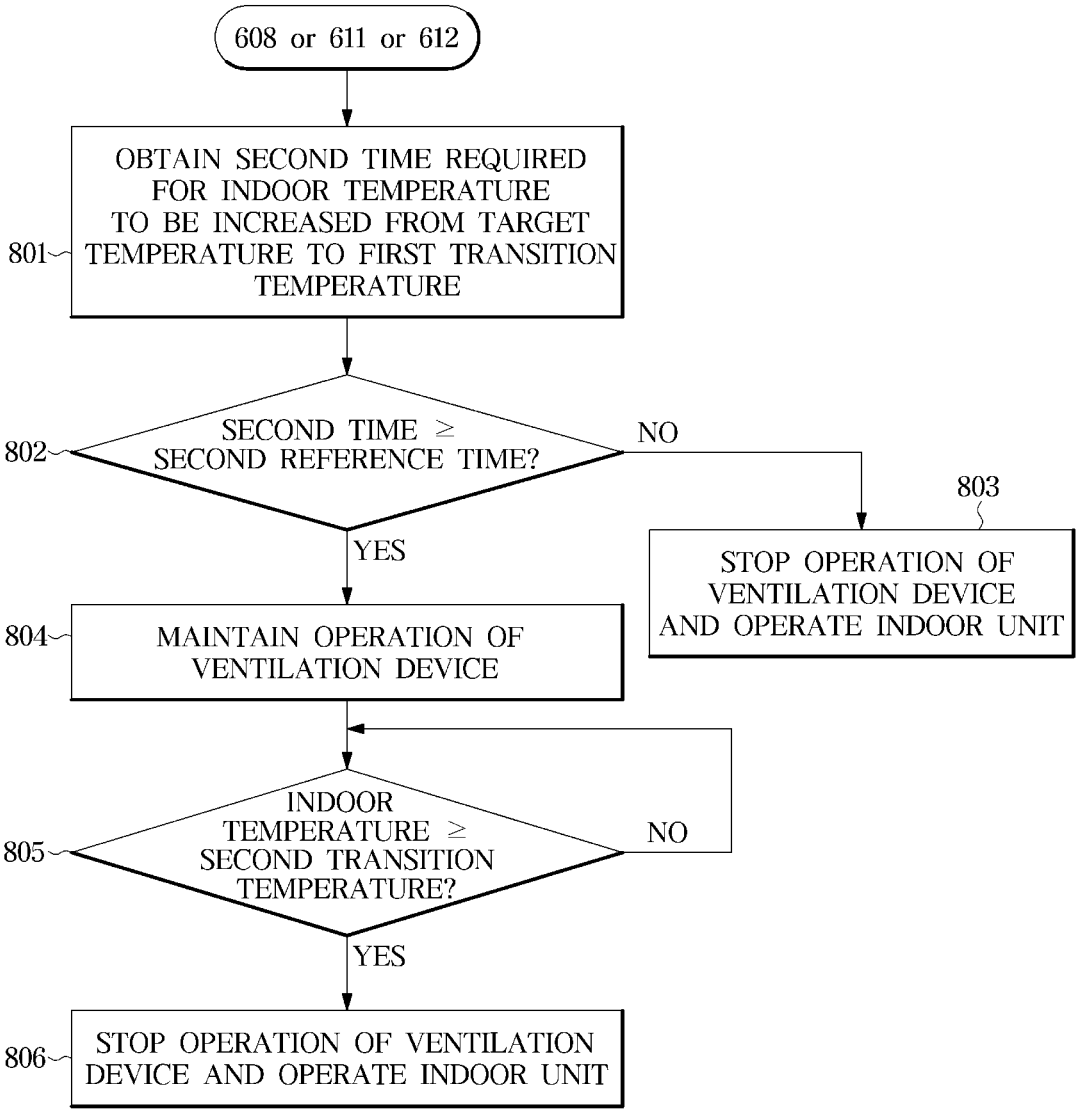
FIG. 15 is a flow chart illustrating a method for determining to stop or to maintain an operation of the ventilation device in details.

FIG. 14 is a graph illustrating the indoor temperature that is increased due to the load of the indoor temperature during the operation of the ventilation device. FIG. 15 is a flow chart illustrating a method for determining to stop or to maintain the operation of the ventilation device in details.

As the indoor temperature Ti is reduced to the stop temperature Ts, the operation of the indoor unit 300 may be stopped. However, after the operation of the indoor unit 300 is stopped, the indoor temperature Ti may be increased. In other words, in a situation in which the indoor unit 300 is not operated and the ventilation device 100 is operated, the indoor temperature Ti may be increased even during the operation of the ventilation device 100. For example, when the load of the indoor temperature is greater than a temperature load that may be removed by the ventilation device 100, the indoor temperature may be increased. As the load of the indoor temperature increases, a rate of increase of the indoor temperature may be increased. When the indoor temperature Ti continues to increase beyond the target temperature Tp despite the operation of the ventilation device 100, the operation of the indoor unit 300 may be required to reduce the indoor temperature Ti.

As described above, the ventilation device 100 may be operated in the first dehumidification mode, the second dehumidification mode, or the ventilation mode. During the ventilation device 100 is operated in the first dehumidification mode, the second dehumidification mode or the ventilation mode (608, 611 or 612), the integrated air conditioning system 2 may determine whether to operate the indoor unit 300 in response to the indoor temperature Ti reaching a first transition temperature Tr1. The first transition temperature Tr1 may be set to be greater than the target temperature Tp by a predetermined second temperature value. For example, the second temperature value may be 1° C. The second temperature value may be changed according to a design or may be set by a user input.

The controller 500 of the integrated air conditioning system 2 may obtain and/or calculate a second time Δt2 that is required for the indoor temperature Ti to be increased from the target temperature Tp to the first transition temperature Tr1 (801). The controller 500 may identify and/or detect a time t3 at which the indoor temperature Ti reaches the target temperature Tp and a time t4 at which the indoor temperature Ti reaches the first transition temperature Tr1. The controller 500 may calculate a time interval between the time t3 and the time t4 as the second time Δt2.

The controller 500 of the integrated air conditioning system 2 may determine whether to operate the indoor unit 300 based on the second time Δt2 required for the indoor temperature Ti to be increased from the target temperature Tp to the first transition temperature Tr1. In addition, whether to stop the operation of the ventilation device 100 may be determined together. That is, the integrated air conditioning system 2 may determine whether to switch from the operation of the ventilation device 100 to the operation of the indoor unit 300. However, in response to the indoor humidity being greater than the reference humidity, the operation of the ventilation device 100 may be continuously maintained.

For example, based on the second time Δt2, which is required for the indoor temperature Ti to be increased from the target temperature Tp to the first transition temperature Tr1, being less than a second reference time (802), the controller 500 of the integrated air conditioning system 2 may stop the operation of the ventilation device 100 and operate the indoor unit 300 (803). The second reference time may be 3 minutes. The second reference time may be changed according to design. Alternatively, the second reference time may be set based on a user input.

That the second time Δt2 is less than the second reference time may mean that the rate of increase of the indoor temperature Ti is greater than a reference rate of increase. In this case, the controller 500 may determine that the load of the indoor temperature is large and that it is impossible to maintain the indoor temperature by the ventilation device 100. Accordingly, in order to maintain the indoor temperature at the target temperature, the controller 500 may operate the indoor unit 300. By switching to the operation of the indoor unit 300, it is possible to prevent a sudden increase in the indoor temperature Ti.

Based on the second time Δt2, which is required for the indoor temperature Ti to be increased from the target temperature Tp to the first transition temperature Tr1, being greater than or equal to the second reference time (802), the controller 500 may maintain the operation of the ventilation device 100 (804). That the second time Δt2 is greater than or equal to the second reference time may mean that the rate of increase of the indoor temperature Ti is less than the reference rate of increase. This may indicate that the load of the indoor temperature is relatively small. Because it is possible to maintain the indoor temperature only by the operation of the ventilation device 100 in response to the load of the indoor temperature being relatively small, the controller 500 may defer the operation of the indoor unit 300.

However, the indoor temperature Ti may continue to increase to reach a second transition temperature Tr2. Based on the indoor temperature Ti being greater than or equal to the second transition temperature Tr2 (805), the controller 500 of the integrated air conditioning system 2 may stop the operation of the ventilation device 100 and operate the indoor unit 300 (806). The second transition temperature Tr2 may be set to be greater than the target temperature Tp by a predetermined third temperature value. For example, the third temperature value may be 2° C. The third temperature value may be changed according to a design or set by a user input. The controller 500 may detect a time t5 at which the indoor temperature Ti reaches the second transition temperature Tr2. In response to the indoor temperature Ti reaching the second transition temperature Tr2, the indoor unit 300 may be operated again. Accordingly, it is possible to prevent the indoor temperature Ti from further being increased.

As mentioned above, a ventilation system, an integrated air conditioning system, and a control method thereof may adjust a temperature and humidity of sucked outdoor air by using a plurality of heat exchangers arranged on an inlet flow path of a ventilation device, and discharge the conditioned air to an indoor space. Therefore, it is possible maintain temperature and humidity of the indoor space in a fresh state.

Further, it is possible to connect a ventilation device to a conventional outdoor unit of air conditioner so as to miniaturize the ventilation device and to reduce a production cost.

Further, by operating a ventilation device and an indoor unit of an air conditioner in conjunction with each other, it is possible to improve energy efficiency and dehumidification efficiency and to reduce energy for cooling and dehumidification.

Further, by appropriately switching an operation of an indoor unit and an operation of a ventilation device based on a load of an indoor temperature, it is possible to improve energy efficiency.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments.

Storage medium readable by machine, may be provided in the form of a non-transitory storage medium. "Non-transitory" means that the storage medium is a tangible device and does not contain a signal (e.g., electromagnetic wave), and this term includes a case in which data is semi-permanently stored in a storage medium and a case in which data is temporarily stored in a storage medium. For example, "non-transitory storage medium" may include a buffer in which data is temporarily stored.

Various embodiments in the disclosure may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium such as the manufacturer's server, the application store's server, or the relay server's memory.

While the present disclosure has been particularly described with reference to exemplary embodiments, it should be understood by those of skilled in the art that various changes in form and details may be made without departing from the spirit and scope of the present disclosure.

What is claimed is:

1. An integrated air conditioning system comprising:
an outdoor unit configured to supply a refrigerant to a ventilator and an indoor unit;
the ventilator including:
a first temperature sensor to sense an indoor temperature,
a first humidity sensor to sense an indoor humidity,
a first blower to flow outdoor air along an inlet flow path, the inlet flow path configured to guide the outdoor air to an indoor space,
a second blower to flow indoor air along an outlet flow path, the outlet flow path configured to guide the indoor air to an outdoor space,
a first heat exchanger in the inlet flow path and connected to the outdoor unit by a first refrigerant pipe, and
a second heat exchanger in the inlet flow path further upstream along the inlet flow path than the first heat exchanger and connected to the first heat exchanger by a second refrigerant pipe;
the indoor unit including:
a second temperature sensor to sense the indoor temperature,
a second humidity sensor to sense the indoor humidity, and
an indoor heat exchanger, the indoor unit configured to discharge heat-exchanged air into the indoor space; and
a controller electrically coupled to the ventilator, the indoor unit, and the outdoor unit, wherein the controller is configured to:
obtain the indoor temperature from the first temperature sensor or the second temperature sensor,
obtain the indoor humidity from the first humidity sensor or the second humidity sensor,
selectively control operation of the ventilator and the indoor unit based on the obtained indoor temperature and the obtained indoor humidity, and
the operation of the ventilator includes:
a first dehumidification mode where the outdoor air is cooled and dehumidified by exchanging heat with at least the first heat exchanger, and
a second dehumidification mode where the outdoor air is cooled and dehumidified by exchanging heat with the second heat exchanger and the heat exchanged air is heated by exchanging heat with the first heat exchanger.

2. The integrated air conditioning system of claim 1, wherein
the controller is further configured to:
operate the indoor unit based on the obtained indoor temperature being greater than or equal to a predetermined reference temperature; and
operate the ventilator based on the obtained indoor humidity being greater than or equal to a predetermined reference humidity.

3. The integrated air conditioning system of claim 2, wherein
the controller is further configured to:
operate the ventilator in the first dehumidification mode to reduce both the indoor temperature and the indoor humidity, based on the obtained indoor temperature being greater than a target temperature, and the obtained indoor humidity being greater than a target humidity; and operate the ventilator in the second dehumidification mode to maintain the indoor temperature and to reduce the indoor humidity, based on the obtained indoor temperature being less than or equal to the target temperature, and the obtained indoor humidity being greater than the target humidity.

4. The integrated air conditioning system of claim 2, wherein the controller is further configured to:

operate the ventilator in a ventilation mode to maintain both of the indoor temperature and the indoor humidity, based on the obtained indoor temperature being less than or equal to a target temperature, and the obtained indoor humidity being less than or equal to a target humidity.

5. The integrated air conditioning system of claim 4, wherein the controller is further configured to:

in the ventilation mode, block a flow of refrigerant to the ventilator so that no refrigerant is supplied to either the first heat exchanger or the second heat exchanger.

6. The integrated air conditioning system of claim 2, wherein the controller is further configured to:

control an expansion valve provided inside the indoor unit to block a flow of the refrigerant from the outdoor unit to the indoor unit, based on the obtained indoor temperature reaching a stop temperature less than a target temperature.

7. The integrated air conditioning system of claim 2, wherein the controller is further configured so that:

when the indoor unit is being operated, the obtained indoor temperature is from the second temperature sensor and the obtained indoor humidity is from the second humidity sensor, and when operation of the indoor unit is stopped, the obtained indoor temperature is from the first temperature sensor and the obtained indoor humidity is from the first humidity sensor.

8. The integrated air conditioning system of claim 2, wherein the ventilator further includes:

a total heat exchanger at a point where the inlet flow path and the outlet flow path intersect and configured so that heat is exchanged between air flowing through the inlet flow path and air flowing through the outlet flow path and the ventilator further includes:

a first expansion valve in a first refrigerant pipe connecting the first heat exchanger to the outdoor unit, and a second expansion valve in a second refrigerant pipe connecting the second heat exchanger to the first heat exchanger.

9. The integrated air conditioning system of claim 8, wherein the controller is further configured to:

control the first expansion valve to expand the refrigerant flowing from the outdoor unit to the first heat exchanger, based on the obtained indoor temperature being greater than a target temperature, and the obtained indoor humidity being greater than a target humidity.

10. The integrated air conditioning system of claim 8, wherein the controller is further configured to:

control the second expansion valve to expand the refrigerant flowing from the first heat exchanger to the second heat exchanger, based on the obtained indoor temperature being less than or equal to a target temperature, and the obtained indoor humidity being greater than a target humidity.

11. The integrated air conditioning system of claim 8, wherein the controller is further configured to:

control the first expansion valve to block a flow of the refrigerant from the outdoor unit to the first heat exchanger, based on the obtained indoor temperature being less than or equal to a target temperature, and the obtained indoor humidity being less than or equal to a target humidity.

12. The integrated air conditioning system of claim 1, wherein the controller further includes:

a display to display operation information of the integrated air conditioning system;

an inputter configured to obtain a user input; and a processor electrically connected to the display and the inputter, and configured to provide a control signal for each operation of the ventilator, the indoor unit, and the outdoor unit.

13. A control method of an integrated air conditioning system comprising an outdoor unit configured to supply a refrigerant to a ventilator and an indoor unit, the ventilator including a first temperature sensor to sense an indoor temperature, a first humidity sensor to sense an indoor humidity, a first blower to flow outdoor air along an inlet flow path, the inlet flow path configured to guide the outdoor air to an indoor space, a second blower to flow indoor air along an outlet flow path, the outlet flow path configured to guide the indoor air to an outdoor space, a first heat exchanger in the inlet flow path and connected to the outdoor unit by a first refrigerant pipe, a second heat exchanger in the inlet flow path further upstream along the inlet flow path than the first heat exchanger and connected to the first heat exchanger by a second refrigerant pipe; the indoor unit including: a second temperature sensor to sense the indoor temperature, a second humidity sensor to sense the indoor humidity, and an indoor heat exchanger, the indoor unit configured to discharge heat-exchanged air into the indoor space; and a controller coupled to the ventilator, the indoor unit, and the outdoor unit, the control method comprising:

obtaining the indoor temperature from the first temperature sensor or the second temperature sensor;

obtaining indoor humidity from the first humidity sensor or the second humidity sensor; and selectively controlling operation of the ventilator and the indoor unit based on the obtained indoor temperature and the obtained indoor humidity, wherein the operation of the ventilator includes:

a first dehumidification mode including cooling and dehumidifying the outdoor air by exchanging heat with at least the first heat exchanger, and a second dehumidification mode including cooling and dehumidifying the outdoor air by exchanging heat with the second heat exchanger and heating the heat exchanged air by exchanging heat with the first heat exchanger.

14. The control method of claim 13, wherein the controlling of the ventilator and the indoor unit includes:

operating the indoor unit based on the obtained indoor temperature being greater than or equal to a predetermined reference temperature; and operating the ventilator based on the obtained indoor humidity being greater than or equal to a predetermined reference humidity.

15. The control method of claim 14, wherein the operating of the ventilator includes:

operating the ventilator in the first dehumidification mode to reduce both the indoor temperature and the indoor humidity, based on the obtained indoor temperature being greater than a target temperature, and the obtained indoor humidity being greater than a target humidity; and operating the ventilator in the second dehumidification mode to maintain the indoor temperature and to reduce the indoor humidity, based on the obtained indoor temperature being less than or equal to the target temperature, and the obtained indoor humidity being greater than the target humidity.

16. The control method of claim 14, wherein the operating of the ventilator includes:

operating the ventilator in a ventilation mode to maintain both of the indoor temperature and the indoor humidity, based on the obtained indoor temperature being less than or equal to a target temperature, and the obtained indoor humidity being less than or equal to a target humidity.

17. The control method of claim 16, wherein the operating the ventilator in the ventilation mode includes:

blocking a flow of refrigerant to the ventilator so that no refrigerant is supplied to either the first heat exchanger or the second heat exchanger.

* * * * *